US009459029B2

(12) United States Patent
Ogawa

(10) Patent No.: US 9,459,029 B2
(45) Date of Patent: Oct. 4, 2016

(54) VALVE CONTROLLER, VALVE CONTROLLING METHOD, REFRIGERATION AND COLD STORAGE SYSTEM, DEVICE AND METHOD FOR CONTROLLING THE SYSTEM

(75) Inventor: Yoshio Ogawa, Setagaya-ku (JP)

(73) Assignee: Fujikoki Corporation, Tokyo (JP)

( * ) Notice: Subject to any disclaimer, the term of this patent is extended or adjusted under 35 U.S.C. 154(b) by 1333 days.

(21) Appl. No.: 12/689,168

(22) Filed: Jan. 18, 2010

(65) Prior Publication Data

US 2010/0180630 A1 Jul. 22, 2010

(30) Foreign Application Priority Data

Jan. 19, 2009 (JP) ..... 2009-08781
Jan. 23, 2009 (JP) ..... 2009-12838
Mar. 12, 2009 (JP) ..... 2009-59796

(51) Int. Cl.
*F25B 41/00* (2006.01)
*F25B 41/04* (2006.01)

(52) U.S. Cl.
CPC ..... *F25B 41/04* (2013.01); *F25B 2600/21* (2013.01); *F25B 2600/2513* (2013.01); *F25B 2600/2515* (2013.01); *F25B 2700/2104* (2013.01); *F25B 2700/21174* (2013.01); *F25B 2700/21175* (2013.01)

(58) Field of Classification Search
CPC ..... F25B 2341/065; F25B 2341/0653; F25B 2500/26; F25B 2500/27; F25B 2600/2513; F25B 2700/21174; F25B 2700/21175
USPC ..... 62/222, 210, 225, 204, 205, 229, 246
See application file for complete search history.

(56) References Cited

U.S. PATENT DOCUMENTS 4,267,702 A * 5/1981 Houk ..... 62/115
4,745,767 A * 5/1988 Ohya ..... F25B 41/062 62/211
7,849,709 B2 * 12/2010 Takada et al. ..... 62/426
2005/0210904 A1 * 9/2005 Roche et al. ..... 62/246
2006/0213208 A1 * 9/2006 Iwaki et al. ..... 62/222
2008/0115516 A1 * 5/2008 Pimentel et al. ..... 62/229

* cited by examiner

*Primary Examiner* — M. Alexandra Elve
*Assistant Examiner* — Daniel C Comings
(74) *Attorney, Agent, or Firm* — Stetina Brunda Garred and Brucker

(57) ABSTRACT

To provide a motor-driven valve with a small number of parts, with excellent assemblage, capable of maintaining a large valve port diameter even downsized, and to prevent deterioration of housing environment due to sound caused by the impact and shortened life that are generated by collisions of closing limit stopper parts. A motor-driven valve according to the present invention comprises: a male screw member rotating in accordance with a rotation of a rotor of an electric motor and engaging with a female screw member fixed to a valve main body; a valve body contacting to and separating from a valve seat in the valve main body by a rotation of the male screw member; two stopper parts rotating in accordance with the rotation of the rotor of the electric motor; an opening limit stopper part mounted to the female screw member, the opening limit stopper part contacting with one of the two stopper parts in a fully-opened state of the motor-driven valve to restrict the rotation of the male screw member in a direction that the motor-driven valve opens; and a closing limit stopper part mounted to the female screw member, the closing limit stopper part contacting with another stopper part in a fully-closed state of the motor-driven valve to restrict the rotation of the male screw member in a direction that the motor-driven valve closes.

6 Claims, 14 Drawing Sheets

VALVE CONTROLLER, VALVE CONTROLLING METHOD, REFRIGERATION AND COLD STORAGE SYSTEM, DEVICE AND METHOD FOR CONTROLLING THE SYSTEM

CROSS-REFERENCE TO RELATED APPLICATIONS

The present application claims priority to Japanese Patent Application No. 2009-8781 filed on Jan. 19, 2009, Japanese Patent Application No. 2009-12838 filed on Jan. 23, 2009 and Japanese Patent Application No. 2009-59796 filed on Mar. 12, 2009.

STATEMENT RE: FEDERALLY SPONSORED RESEARCH/DEVELOPMENT

Not Applicable

BACKGROUND OF THE INVENTION

1. Field of the Invention

The present invention relates to a valve controller for controlling valve opening of a motor-driven valve, particularly to a controller for valve opening control when an abnormality occurs in a temperature sensor, a pressure sensor and the like. In addition, the present invention relates to a valve controller and a valve controlling method, particularly to a controller and so on for controlling valve opening of a motor-driven valve and others for adjusting flow rate of a refrigerant. Further, the present invention relates to a refrigeration and cold storage system used for a refrigeration and cold storage show case and so on, and a device and a method for controlling the system, particularly to a refrigeration and cold storage system and the like in which operation/stoppage of a compressor is switched in accordance with a temperature of a controlled object.

2. Description of the Related Art

Conventionally, in a refrigeration cycle used for refrigeration and cold storage show cases and the others, in order to accurately adjust flow rate of a circulating refrigerant, as an expansion valve for flow control, a motor-driven valve with a pulse motor for moving a valve body has widely been utilized. In this refrigeration cycle, generally, a degree of superheat is calculated after detecting inlet and outlet temperatures of an evaporator with temperature sensors, and valve opening of the motor-driven valve is controlled by comparing the calculated degree of superheat with a preliminarily set degree of superheat.

As described above, although the valve opening control of the motor-driven valve is performed based on the temperature detected by the temperature sensor, at the operation of the refrigeration cycle, there is a possibility that the temperature cannot appropriately be detected when an abnormality occurs in the temperature sensor due to disconnection, short circuit and the like in operation, in such case, it becomes impossible to continue the valve opening control of the motor-driven valve also. Then, in a conventional valve controller, in its manufacturing stage, a fully-closed value or a fully-opened value is set as an opening value for emergency, when an abnormality occurs in the temperature sensor, the motor-driven valve is controlled to stop in the fully-closed or fully-opened state (see Patent document 1 as an example).

But, when the motor-driven valve is stopped in the fully-closed state, after that, all the while, a refrigerant does not flow in the refrigeration cycle, so that the operation of the refrigeration cycle stops due to a low-pressure abnormality, which makes it impossible, as an example, to maintain inside temperature of a refrigeration and cold storage show case low. As a result, until a maintenance worker arrives, the inside temperature remains high over a long period of time, resulting in bruised foods.

On the other hand, in case that the motor-driven valve is stopped in the fully-opened state, circulation of the refrigerant is not stopped but the quantity of refrigerant fed to the evaporator becomes too much, so that a refrigerant from the evaporator is returned to the compressor in the form of liquid (liquid back). In this case also, the show case cannot be cooled in the same manner as described above, which may cause bruised foods, moreover, there is a fear that the compressor is damaged through liquid compression.

These problems can be generated not only when an abnormality occurs in the temperature sensor but in a pressure sensor for detecting pressure of a refrigerant circulating in the refrigeration cycle almost in the same manner as described above, so that it has been a key problem to consider a measure in case of abnormality in the sensors for detecting temperature and pressure in the refrigeration cycle.

Further, conventionally, in refrigeration cycle systems used for air-conditioners, refrigeration and cold storage show cases, and the like, flow rate of a circulating refrigerant is adjusted for the purposes of stabilizing a cooling capacity, efficient operation, and the like, and in order to accurately performing the adjustment, as an expansion valve for controlling the flow rate, a motor-driven valve that is a motor-driven expansion valve with a pulse motor for moving the valve body has been widely utilized.

However, since the valve opening control of the motor-driven valve is generally performed with an open-loop control that doesn't feed back an absolute opening (actual opening), in addition, when a power-supply to the motor-driven valve is stopped, the valve body in the motor-driven valve stops at a position when the power-supply is stopped without returning to an initial position, so that at and after the second a power-supply after the first supply, it is impossible to exactly grasp an absolute opening (a position of the valve body) when the power-supply is started.

Therefore, in the control of the motor-driven valve, generally, an initialization processing is performed when power is supplied to the valve, and the valve opening control is started after determining the initial position of the valve body (for instance, see Patent document 2). Here, it is the initialization processing to drive the motor-driven valve so as to be closed by applying the number of pulses over all the strokes from the fully-opened state to the fully-closed state to forcibly change the valve opening of the motor-driven valve to that in fully-closed state.

However, in the refrigeration cycle system, there is a possibility that foreign substances such as impure substances are generated in a refrigerant flow passage, in the foreign substances, large ones can be removed by a strainer and so on, but small ones may pass through the strainer and flow into the inside of the motor-driven valve. In such a case, in the motor-driven valve are caught the foreign substances, which may cause a shift in the valve opening of the valve.

That is, in case that the catching of the foreign substance occurs, since the foreign substance prevents the valve body from moving, for example, when a driving signal of 100 pulses are added to the pulse motor, an actual amount to be driven becomes smaller than that when driving the signal of 100 pulses are given. As a result, a difference of several pulses is generated between a valve opening estimated from the number of pulses added to the motor-driven valve and an actual valve opening of the motor-driven valve itself, after that, the motor-driven valve is operated with the valve opening including the difference.

For this reason, it becomes impossible to accurately control the valve opening of the motor-driven valve, for instance, when a driving signal for obtaining the fully-closed state is added to the motor-driven valve, the motor-driven valve is actually in a slightly-opened state. In this case, it is possible to generate a leak of a refrigerant and the like, resulting in deteriorated reliability of the device and so on.

Further, generally, in the refrigeration and cold storage show cases utilized for cold reserving and displaying foods and the like, operation/stoppage of the compressor is switched in accordance with high/low of the inside temperature, and the switching action is repeated according to the change in the inside temperature, which controls the inside temperature to be maintained constant.

The switching of the operation/stoppage of the compressor is performed in such a manner that the compressor is operated at the moment that the inside temperature becomes higher or equal to a predetermined setting temperature for turning the compressor on, and the operation of the compressor is stopped at the moment that the inside temperature becomes lower or equal to a predetermined setting temperature for turning the compressor off. A difference between the setting temperatures for turning the compressor on/off is called "DIFFERENTIAL", which is set to avoid frequent operation/stoppage actions (hunting) of the compressor.

In addition, flow rate of a circulating refrigerant in the refrigeration cycle is adjusted for the purposes of stabilization of a cooling capacity when cooling inside of a refrigeration and cold storage showcase, efficient operation, and the like, and in order to accurately performed the adjustment, as a flow control valve for the refrigerant, a motor-driven expansion valve with a pulse motor or the like has widely been used. In the refrigeration cycle with the motor-driven expansion valve, a degree of superheat of a refrigerant flowing the evaporator is detected, and the detected degree of superheat is compared with a setting degree of superheat, and in accordance with the difference, the flow rate of the refrigerant is controlled through adjustment of the valve opening of the motor-driven expansion valve using a PID control and others.

By the way, as described above, when operation/stoppage of the compressor is switched, according to this motion of the compressor, opening/closing of the expansion valve needs to be controlled. As a method of controlling the valve, for example, in the Patent document 3 is disclosed a technique that at the stoppage of the compressor is controlled the motor-driven expansion valve so as to be fully-closed once, and a predetermined period of time later, the valve is fully-opened to uniform gas pressure in a refrigeration cycle, and when starting the operation of the compressor, the valve opening of the valve is set to be an initial opening (preliminarily set standard opening) or a memorized opening (the valve opening just before the compressor stops).

The technique disclosed in the Patent document 3 is applied to air conditioners for adjusting room temperature, so that the gas pressure in the cycle is uniformed in the fully-opened state, on the contrary, in refrigeration and cold storage show cases, to avoid increasing the inside temperature, the uniformity of the gas pressure at the stoppage of the compressor is not carried out in general. For this reason, in case that the technique described above is applied to the control of the refrigeration and cold storage show cases, when the compressor is stopped, the valve opening of the motor-driven expansion valve is controlled to be the fully-closed state, and the valve opening is set to be the initial opening or the memorized opening when starting the operation of the compressor.

However, as described above, in case that the valve opening of the motor-driven expansion valve is switched between the fully-closed opening and the initial opening (or the memorized opening) in accordance with the operation/stoppage of the compressor, in each switching operation/stoppage of the compressor, the valve opening of the valve is to be changed with great operation amount.

In addition, in the refrigeration and cold storage show cases, the number of switching of the operation/stoppage of the compressor is comparatively large, there are quite a few case that is required a heavy switching action repeating operation/stoppage at five minute intervals. In such a case, the number of switching operation/stoppage of the compressor is more than ten times an hour, resulting in seriously increased driving frequency of the motor-driven expansion valve.

Further, the motor-driven expansion valve is a machine component with sliding parts, so that as the driving frequency increases, abrasion of the sliding parts advances to shorten the life of the valve, and its durability life is generally defined in terms of the number of the driving pulses added to the pulse motor. For this reason, when the number of driving pulses added to the pulse motor is considerably increased by changing the valve opening as described above, remaining number of pulses defined as the durability life are rapidly consumed, resulting in shortened life of the motor-driven expansion valve. As a result, frequent replacements of the motor-driven expansion valve are forced to be carried out, consequently, generating a problem of decreased reliability of the refrigeration and cold storage show cases.

Patent document 1: Japanese Patent Publication No. Heisei 11-230624 gazette

Patent document 2: Japanese Patent No. 3936345 gazette

Patent document 3: Japanese Examined Utility Model Publication (Kokoku) No. Heisei 2-3093 gazette

BRIEF SUMMARY OF THE INVENTION

The present invention has been made in consideration of the problems, and the object thereof is to provide a valve controller and others capable of improving reliability of refrigeration systems and lengthening life of the systems.

In detail, the object of the present invention is to appropriately control valve opening of a motor-driven valve and to prevent damage of a controlled object for its temperature when an abnormality occurs in a temperature sensor, a pressure sensor or the like, and also the object is to appropriately modify a difference in the valve opening of the motor-driven valve caused by a catching of a foreign substance or the like and to prevent a trouble such as refrigerant leakage. Further, the object of the present invention is to prevent the number of driving pulses of a driving signal for driving a motor-driven valve from excessively increasing under a condition that operation/stoppage of a compressor is frequently switched to lengthen the life of the motor-driven valve, consequently, to improve reliability of the refrigeration and cold storage system itself.

To achieve the above object, the present invention relates to a valve controller for detecting one of temperature and pressure of a refrigeration cycle based on an output value of a sensor and controlling valve opening of a motor-driven valve based on a detected value, and the valve controller is characterized by comprising: valve opening setting means for performing one of setting and changing an emergency valve opening of the motor-driven valve; and valve opening controlling means for stopping, when an abnormality occurs in the sensor, movement of the motor-driven valve at an emergency valve opening to which one of the setting and the changing is performed through the valve opening setting means.

With the valve controller of the present invention, when an abnormality occurs in the sensor the motor-driven valve is stopped at the set or changed emergency valve opening, so that setting an intermediate valve opening, as the emergency valve opening, between the valve openings in the fully-opened and the fully-closed states, as an example, prevents the refrigeration cycle from unintentionally stopping. As a result, even when a prompt repair work cannot be conducted it becomes possible to prevent the object to be managed for its temperature from being damaged. In addition, the emergency valve opening can freely be set or changed, which allows the emergency valve opening to suitably be set in accordance with usage of the refrigeration cycle and user's request, resulting in a refrigeration cycle with improved flexibility and convenience.

In the valve controller as described above, the emergency valve opening can be larger than a valve opening in a fully-closed state and smaller than a valve opening in a fully-opened state, and may be a valve opening capable of continuing operation of the refrigeration cycle.

In the above valve controller, the sensor may be one of a temperature sensor for detecting temperature of a controlled object and a pressure sensor for detecting pressure of a refrigerant circulating in the refrigeration cycle.

It is possible that the valve controller described above further comprises communication means for performing one of setting and changing the emergency valve opening from an outer device by utilizing one of wire communication and wireless communication.

Further, in the above valve controller, the motor-driven valve may be one of an expansion valve in the refrigeration cycle and a flow control valve in a hot gas bypass circuit of the refrigeration cycle.

Still further, the present invention relates to a valve controller for controlling valve opening of a motor-driven valve and initialization processing of the motor-driven valve, the valve controller is characterized by comprising: valve opening controlling means for controlling valve opening of the motor-driven valve; initialization time setting means for setting initialization time that determines intervals for performing the initialization processing of the motor-driven valve; time measuring means for measuring elapsed time; and initialization controlling means for performing the initialization processing of the motor-driven valve when elapsed time that is measured by the time measuring means reaches to the initialization time and the valve opening controlling means stops valve opening control of the motor-driven valve as well.

With the valve controller of the present invention, the initialization time can be set, and each time the elapsed time that is measured by the time measuring means reaches to the initialization time, the initialization processing of the motor-driven valve is performed, so that not only at the power-up but after that, the initialization processing can periodically be carried out. As a result, even when a difference in valve opening caused by catching of a foreign substance or the like is generated, the difference can periodically be modified, which allows the valve opening of the motor-driven valve to accurately be controlled.

In addition to the above, the initialization processing is performed only at the stoppage of the valve opening control of the motor-driven valve, so that the initialization processing can be performed without harmful effect to the valve opening control of the motor-driven valve. As a result, it is unnecessary to stop the operation of devices for the initialization processing, which allows hindrance to the operation of devices to be avoided and complexity accompanying the operation to be eliminated as well.

In the above valve controller, it is possible that the valve opening controlling means calculates a deviation between a detected temperature of an object to be adjusted for its temperature and a target temperature; calculates a target valve opening based on the deviation; and controls valve opening of the motor-driven valve so as to be the target valve opening.

In the valve controller described above, the motor-driven valve can be a motor-driven expansion valve in a refrigeration cycle, and the detected temperature may be a degree of superheat.

In the valve controller, it is possible that in the refrigeration cycle are connected a compressor, a condenser, a motor-driven valve and an evaporator in this order, and operation/stoppage of the compressor is switched in accordance with a temperature of a controlled object, and the initialization controlling means performs the initialization processing of the motor-driven valve when elapsed time that is measured by the time measuring means reaches to the initialization time and the compressor stops as well.

Further, in the valve controller, it is possible that the refrigeration cycle is provided with a solenoid-operated valve disposed between the condenser and the evaporator to open/close a refrigerant flow passage between them, and the valve controller is provided with solenoid-operated valve controlling means for closing the solenoid-operated valve when operation of the compressor stops and for opening the solenoid-operated valve when operation of the compressor is restarted, and the initialization controlling means performs initialization processing of the motor-driven valve when elapsed time that is measured by the time measuring means reaches to the initialization time and the solenoid-operated valve is closed as well.

In the valve controller, when the solenoid-operated valve is closed the valve opening controlling means may maintain a valve opening of the motor-driven valve at an opening when operation of the compressor stops, and when the solenoid-operated valve is opened the valve opening controlling means can start valve opening control of the motor-driven valve from the opening at the stoppage of the compressor. With this, the operation amount of the motor-driven valve accompanying switching of operation/stoppage of the compressor can be small, which makes it possible to lengthen the life of the motor-driven valve.

Further, the valve controller described above may further comprises communication means for setting the initialization time from an outer device by utilizing one of wire communication and wireless communication.

Still further, the present invention relates to a valve controlling method of controlling valve opening of a motor-driven valve as well as initialization processing of the motor-driven valve, and the method is characterized by comprising the steps of: measuring elapsed time and judging whether or not the measured elapsed time reaches to an initialization time that determines intervals for performing the initialization processing of the motor-driven valve; and performing the initialization processing of the motor-driven valve when the measured elapsed time reaches to the initialization time, and valve opening control of the motor-driven valve stops as well.

Further, the present invention relates to a refrigeration and cold storage system, in which a compressor, a condenser, a motor-driven expansion valve and an evaporator are connected in this order, the refrigeration and cold storage system switching operation/stoppage of the compressor in accordance with a temperature of a controlled object, further comprising a solenoid-operated valve disposed between the condenser and the evaporator to open/close a refrigerant flow passage between them, wherein when operation of the compressor is stopped the solenoid-operated valve is closed and a valve opening of the motor-driven expansion valve is maintained at an opening when the operation of the compressor stops, and when the operation of the compressor is restarted the solenoid-operated valve is opened and valve opening control of the motor-driven expansion valve starts from the opening at the stoppage of the compressor.

With the refrigeration and cold storage system of the present invention, the solenoid-operated valve is disposed between the condenser and the evaporator, and when operation of the compressor is stopped the solenoid-operated valve is closed and the valve opening of the motor-driven expansion valve is maintained at the opening when the operation of the compressor stops, and when the operation of the compressor is restarted the solenoid-operated valve is opened and the valve opening control of the motor-driven expansion valve starts from the opening at the stoppage of the compressor, which makes it possible that operations for fully-closing the motor-driven expansion valve at the stoppage of the compressor and opening the motor-driven expansion valve at the start of the compressor are unnecessary while preventing inside temperature at the stoppage of the compressor from increasing. As a result, it becomes unnecessary to largely change the valve opening of the motor-driven expansion valve each time the operation/stoppage of the compressor is switched, which remarkably reduces the consumption of the number of driving pulses. This allows the life of the motor-driven expansion valve to be lengthened, consequently, the reliability of the refrigeration and cold storage system to be improved.

Further, the present invention relates to a controller for controlling motion of a refrigeration and cold storage system, the refrigeration and cold storage system having a refrigeration cycle in which a compressor, a condenser, a motor-driven expansion valve and an evaporator are connected in this order and a solenoid-operated valve disposed between the condenser and the evaporator to open/close a refrigerant flow passage between them, the refrigeration and cold storage system switching operation/stoppage of the compressor in accordance with a temperature of a controlled object, wherein the controller, when stopping the operation of the compressor, closes the solenoid-operated valve and maintains valve opening of the motor-driven expansion valve at an opening when the operation of the compressor stops, and when restarting the operation of the compressor, opens the solenoid-operated valve and starts valve opening control of the motor-driven expansion valve from the opening at the stoppage of the compressor.

With the present invention, in the same manner as the above inventions, even when the operation/stoppage of the compressor is frequently switched, it is possible to prevent the number of driving pulses of the driving signal for driving the motor-driven expansion valve from becoming considerably large, which lengthens the life of the valve, consequently, improves the reliability of the refrigeration and cold storage system itself.

The controller of the refrigeration and cold storage system may further comprises: a first control section for switching operation/stoppage of the compressor in accordance with the temperature of the controlled object and controlling opening/closing of the solenoid-operated valve; and a second control section for controlling valve opening of the motor-driven expansion valve in accordance with a degree of superheat of a refrigerant flowing the evaporator, wherein the second control section monitors opened/closed state of the solenoid-operated valve and stops outputting a driving signal for the valve opening control in accordance with the closing of the solenoid-operated valve.

In the controller of the refrigeration and cold storage system, the first control section operates the compressor when the temperature of the controlled object is higher or equal to a first setting value that is set at a predetermined temperature, and the first control section stops operation of the compressor when the temperature of the controlled object is lower or equal to a second setting value that is lower than the first setting value.

In the controller of the refrigeration and cold storage system, the refrigeration and cold storage system is used for a refrigeration and cold storage showcase for foods, and the temperature of controlled object is an inside temperature of the refrigeration and cold storage showcase.

Further, the present invention relates to a method of controlling motion of a refrigeration and cold storage system, the refrigeration and cold storage system having a refrigeration cycle in which a compressor, a condenser, a motor-driven expansion valve and an evaporator are connected in this order and a solenoid-operated valve disposed between the condenser and the evaporator to open/close a refrigerant flow passage between them, the refrigeration and cold storage system switching operation/stoppage of the compressor in accordance with a temperature of a controlled object, wherein the method comprising the steps of: when stopping the operation of the compressor, closing the solenoid-operated valve and maintaining a valve opening of the motor-driven expansion valve at an opening when the operation of the compressor stops; and when restarting the operation of the compressor, opening the solenoid-operated valve and starting valve opening control of the motor-driven expansion valve from the opening when the operation of the compressor is stopped.

As described above, with the present invention, it becomes possible to provide a valve controller and others capable of improving reliability of refrigeration systems and lengthening life of the systems.

In detail, it is possible to appropriately control valve opening of a motor-driven valve and to prevent damage of a controlled object for its temperature when abnormality occurs in a temperature sensor, a pressure sensor or the like, and also it is possible to appropriately modify a difference in the valve opening of the motor-driven valve caused by a catching of a foreign substance or the like and to prevent a trouble such as refrigerant leakage. Further, it is possible to prevent the number of driving pulses of a driving signal for driving a motor-driven valve from excessively increasing under a condition that operation/stoppage of a compressor is frequently switched to lengthen the life of the motor-driven valve, consequently, to improve reliability of the refrigeration and cold storage system itself.

BRIEF DESCRIPTION OF THE DRAWINGS

The present invention will be more apparent from the ensuring description with reference to the drawings, wherein.

DETAILED DESCRIPTION OF THE INVENTION

A valve controller according to the first embodiment of the present invention will be explained with reference to FIGS. 1 to 6. Here, as a refrigeration cycle system is exemplified a system for controlling temperature inside a refrigeration and cold storage showcase used for cold reserving and displaying foods, in addition, the valve controller of the present invention is exemplarily used for a device for controlling an expansion valve (motor-driven valve) disposed in the above refrigeration cycle system.

Figure 1:
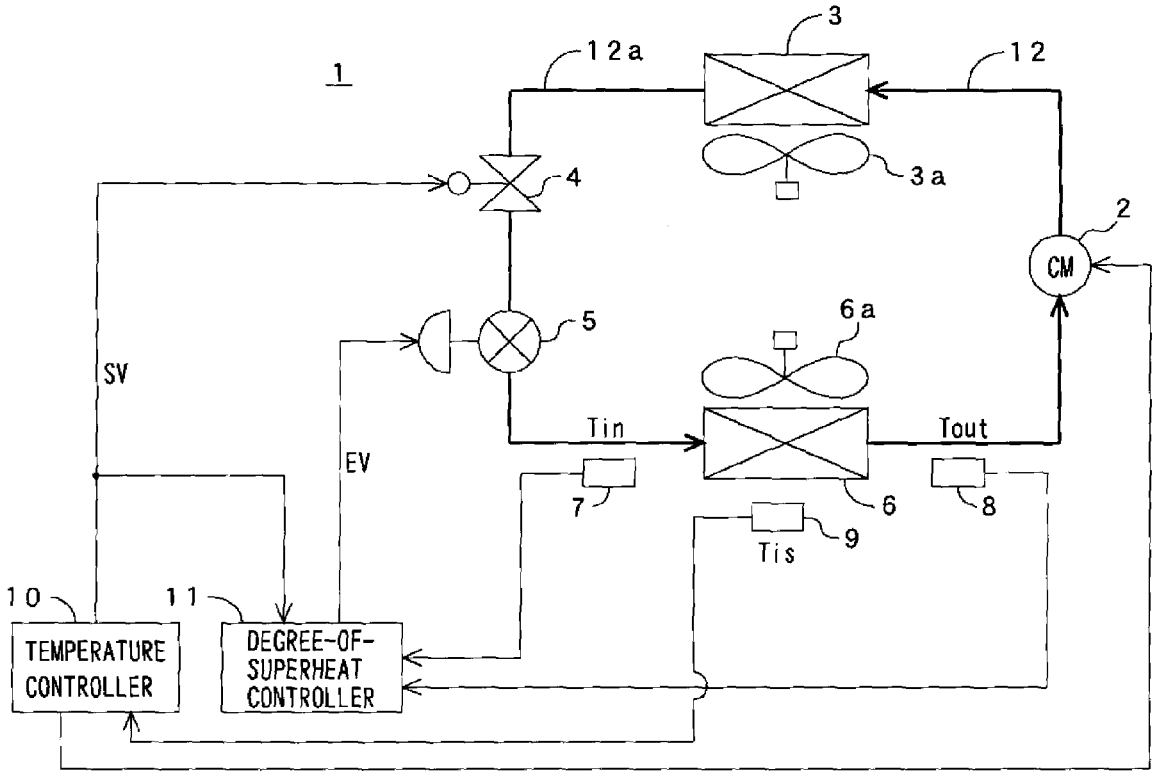
FIG. 1 is a drawing showing the construction of an example of a refrigeration cycle system with a valve controller according to the first embodiment of the present invention.

FIG. 1 shows the refrigeration cycle system with the valve controller according to the present invention, and the system 1 is provided with a compressor 2, a condenser 3, a condenser fan 3*a*, a solenoid-operated valve 4, a motor-driven valve 5, an evaporator 6, an evaporator fan 6*a*, an inlet temperature sensor 7, an outlet temperature sensor 8, an inside temperature sensor 9, a temperature controller 10 and a degree-of-superheat controller 11.

The compressor 2, the condenser 3, the solenoid-operated valve 4, the motor-driven valve 5 and the evaporator 6 are connected with each other through a conduit 12, and among them circulates a refrigerant. Here, the quantity of the refrigerant flowing through the conduit 12 is controlled by adjusting valve opening of the motor-driven valve 5.

The compressor 2 compresses the refrigerant in low pressure gas state fed from the evaporator 6 and changes it into high pressure gas state so as to be fed to the condenser 3 through the conduit 12.

The condenser 3 condenses the refrigerant in high pressure gas state fed from the compressor 2 to change it into a refrigerant in high pressure liquid state with condensation heat being removed, and the condenser 3 releases the removed heat to outside through air blow by the condenser fan 3*a*.

The solenoid-operated valve 4 is installed to open/close a refrigerant flow passage 12*a* between the condenser 3 and the evaporator 6 and to change flow/non-flow of the refrigerant into the evaporator 6. This solenoid-operated valve 4 operates depending on a solenoid-operated valve driving signal SV outputted from the temperature controller 10, and the valve 4 opens/closes in accordance with a voltage level of the solenoid-operated valve driving signal SV.

The motor-driven valve 5 changes the refrigerant in high pressure liquid state fed from the condenser 3 into low pressure state. This valve 5 is provided with a built-in pulse motor 5*a* (shown in FIG. 2) that is driven in accordance with a motor-driven valve driving signal EV from the degree-of-superheat controller 11, and the valve opening of the valve 5 is adjusted by the rotation of the pulse motor 5*a* with rotational angles in accordance with the number of pulses of the motor-driven valve driving signal EV.

The evaporator 6 is provided to evaporate (vaporize) the refrigerant in low pressure liquid state, and the refrigerant removes evaporation heat from its circumference through the evaporation, and is heated. At this moment, the removed heat cools ambient air around the evaporator 6, and the cooled air is released by the air blow by the evaporator fan 6*a* to adjust temperature inside the refrigeration and cold storage show case.

The inlet temperature sensor 7, the outlet temperature sensor 8 and the inside temperature sensor 9 detect a temperature Tin of the refrigerant at the inlet of the evaporator 6 (the refrigerant in liquid state), a temperature Tout of the refrigerant at the outlet of the evaporator 6 (the refrigerant in gas state) and a temperature Tis inside the refrigeration and cold storage show case respectively. These sensors 7 to 9 are constructed by thermistors with negative temperature-resistance characteristic for instance.

The temperature controller 10 is a control circuit for adjusting temperature inside the refrigeration and cold storage show case by controlling operation/stoppage of the compressor 2, and is constructed, for example, by a microcomputer and peripheral circuits (both of them are not shown). The temperature controller 10 compares the inside temperature Tis detected by the inside temperature sensor 9 and a preliminarily set temperature Ton for turning on the compressor 2 (hereinafter called as "ON set temperature"), and a preliminarily set temperature Toff for turning off the compressor 2 (hereinafter called as "OFF set temperature") with each other, and in accordance with the results, controls the operation/stoppage of the compressor 2. And, between the ON set temperature Ton and the OFF set temperature Toff is set a "DIFFERENTIAL (difference in temperature)" to avoid frequent operation/stoppage actions (hunting) of the compressor 2.

In addition, the temperature controller 10 has a function of controlling opening/closing of the solenoid-operated valve 4 in accordance with an operating condition of the compressor 2 also, and the opening/closing control of the valve 4 is performed through the solenoid-operated valve driving signal SV. This solenoid-operated valve driving signal SV is set at a voltage level (for example AC 200V) for opening the solenoid-operated valve 4 while the compressor 2 is in operation, on the other hand, the signal SV is set at a voltage level (for example 0V) for closing the solenoid-operated valve 4 while the compressor 2 is in stoppage.

The degree-of-superheat controller 11 is a control circuit for controlling valve opening of the motor-driven valve 5, and is constructed, for example, by a microcomputer and peripheral circuits in the same manner as the temperature controller 10. This controller 11 calculates valve opening of the motor-driven valve 5 through a PID control based on a degree of superheat Tsh of the refrigerant in the evaporator 6 (the temperature Tout detected by the outlet temperature sensor 8–the temperature Tin detected by the inlet temperature sensor 7), and outputs the motor-driven valve driving signal EV corresponding to the calculated valve opening to the pulse motor 5*a* of the motor-driven valve 5.

In addition, the degree-of-superheat controller 11 has a function of monitoring abnormality in the inlet temperature sensor 7 and the outlet temperature sensor 8 also, in case that outputs of these temperature sensor 7, 8 are abnormal, the controller 11 changes the valve opening of the motor-driven valve 5 to a preliminarily set emergency valve opening SP. Further, as will hereinafter be described in detail, the emergency valve opening SP can be set any value by one pulse by users.

Figure 2:
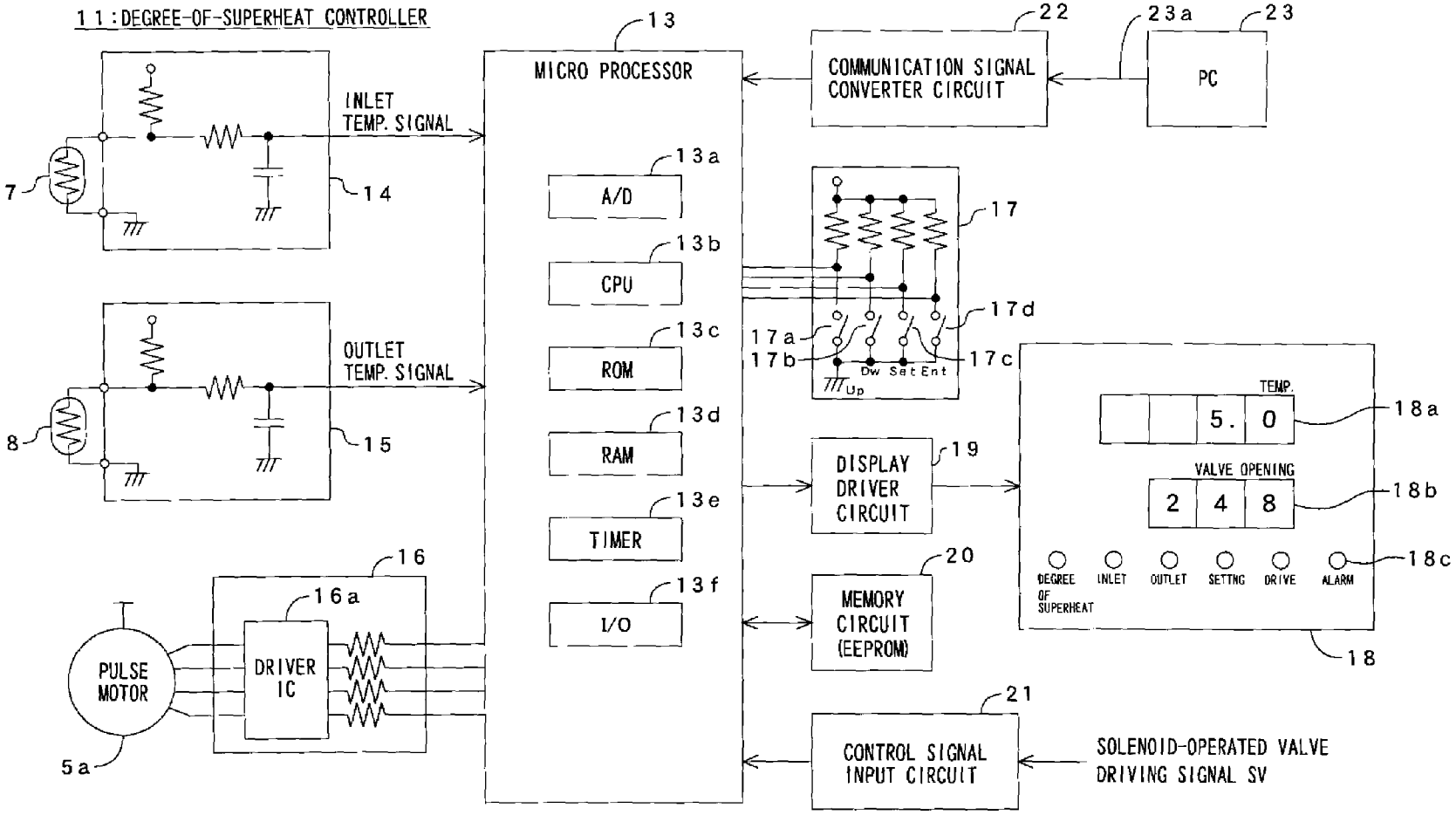
FIG. 2 is a block diagram showing a degree-of-superheat controller shown in FIG. 1 and peripheral circuits around the controller in detail.

The degree-of-superheat controller 11 is, as shown in FIG. 2, provided with a micro processor 13, an inlet temperature detecting circuit 14, an outlet temperature detecting circuit 15, a motor-driven valve driving circuit 16, an input circuit 17, a display circuit 18, a display driver circuit 19, a memory circuit (EEPROM) 20, a control signal input circuit 21 and a communication signal conversion circuit 22.

The inlet temperature detecting circuit 14 is a resistance-voltage conversion circuit that converts a resistance value of the inlet temperature sensor 7 to a DC-voltage signal and outputs it to the micro processor 13. This inlet temperature detecting circuit 14 provides an electric signal (inlet temperature signal) corresponding to the temperature Tin of the refrigerant at the inlet of the evaporator 6 to the micro processor 13.

The outlet temperature detecting circuit 15 is a resistance-voltage conversion circuit that converts a resistance value of the outlet temperature sensor 8 to a DC-voltage signal and outputs it to the micro processor 13. This outlet temperature detecting circuit 15 provides an electric signal (outlet temperature signal) corresponding to the temperature Tout of the refrigerant at the outlet of the evaporator 6 to the micro processor 13.

The input circuit 17 is disposed to input a set degree of superheat (target temperature) Ts, upper and lower opening limits of the motor-driven valve 5 (for instance, when the motor-driven valve 5 is used with 100 pulses to 400 pulses, the upper opening limit is set to be 400 pulses and the lower opening limit to be 100 pulses), each coefficient for P (proportional), I (integral) and D (differential) at a PID control, the emergency valve opening SP and so on. These varieties of input values can be set as setting values, and the setting values set can be changed with the input circuit 17 also. Methods of setting the input value and changing the setting value will be explained below in detail.

This input circuit 17 is provided with four tact switches 17*a* to 17*d* (an up switch 17*a*, a down switch 17*b*, a set switch 17*c* and an enter switch 17*d*), and ON/OFF states of the tact switches 17*a* to 17*d* are outputted to the micro processor 13.

The display circuit 18 is provided with a temperature displaying element 18*a*, a valve opening displaying element 18*b* and a plurality of LEDs 18*c*. The temperature displaying element 18*a* displays the refrigerant temperature Tin at the inlet and the refrigerant temperature Tout at the outlet of the evaporator 6, and the degree of superheat Tsh (=Tout−Tin) while switching them, and in a setting mode, setting values of the set degree of superheat Ts, the upper opening limit, the lower opening limit, the emergency valve opening SP and others are displayed. In addition, the valve opening displaying element 18*b* displays the present valve opening of the motor-driven valve 5 by the number of pulses from the fully-closed state.

The plurality of LEDs 18*c* turn on in relation to displayed items of the temperature displaying element 18*a* and the valve opening displaying element 18*b*, and consist of six LEDs from "degree of superheat" to "alarm". Each LED for "degree of superheat", "inlet" and "outlet" shows a displayed item of the temperature displaying element 18*a* and turns on in relation to the temperature displayed on the temperature displaying element 18*a*. Further, the LED for "setting" turns on when the degree-of-superheat controller 11 is in a setting mode, and the LED for "drive" turns on when the controller 11 is in operation. The LED for "alarm" turns on when an output data of the inlet temperature sensor 7 or the outlet temperature sensor 8 is abnormal.

The display driver circuit 19 amplifies a signal from the micro processor 13 and outputs the amplified signal to the display circuit 18. The memory circuit 20 stores the above setting values and so on for backing up.

The motor-driven valve driving circuit 16 is disposed to amplify a driving control signal from the micro processor 13 and to output driving pulses to the pulse motor (stepping motor) 5*a* built in the motor-driven valve 5, and is provided with a driver IC (integrated circuit) (driving signal amplifying circuit) 16*a*, etc.

The micro processor 13 is provided with an A/D converter 13*a*, a CPU (Central Processing Unit) 13*b*, a ROM 13*c*, a RAM 13*d*, a timer 13*e*, an I/O (13*f*) and so on.

The A/D converter 13*a* converts analog signals on temperature outputted from the inlet temperature detecting circuit 14 and the outlet temperature detecting circuit 15 into digital signals, and the CPU 13*b* interprets and executes programs stored in the ROM 13*c*. The ROM 13*c* is a nonvolatile memory storing an operation program for executing valve opening control by PID control operation described below, a program for controlling valve opening of the motor-driven valve 5 when an abnormality occurs in the temperature sensors 7,8, a display control program and so on. The RAM 13*d* functions as a work memory of the CPU 13*b*. The timer 13*e* is provided to perform interrupt processing and so on, and the I/O (13*f*) is provided to exchange data between the CPU 13*b* and other devices.

The control signal input circuit 21 converts the solenoid-operated valve driving signal SV (alternating current voltage signal: 200V-0V) outputted from the temperature controller 10 into a binary signal of DC voltage (DC5V-0V) and outputs the binary signal to the micro processor 13 as a signal indicating opened/closed state of the solenoid-operated valve 4.

The communication signal conversion circuit 22 is an interface circuit to connect an external device such as personal computer (PC) 23 to the micro processor 13 via a connection cable 23*a* or the like, and is disposed to input various setting values such as the set degree of superheat Ts, the emergency valve opening SP and the others from the operation of the PC 23. This circuit 22 performs mutual conversion of signal's voltage level, the number of input and output terminals and the like in accordance with differences between a signal format on the side of the micro processor 13 and that on the side of the PC 23, for instance, and the circuit 22 is composed of a RS-232C transceiver IC, etc.

Next, the operation of the refrigeration cycle system 1 with the construction described above will be explained. Here, at first, the interrupt processing performed by the temperature controller 10 will be explained with reference to FIGS. 1, 3. During the operation of the system, the temperature controller 10 carries out a routine shown in FIG. 3 while using a timer (not shown) or the like at predetermined intervals (every ten seconds, as an example).

Figure 3:
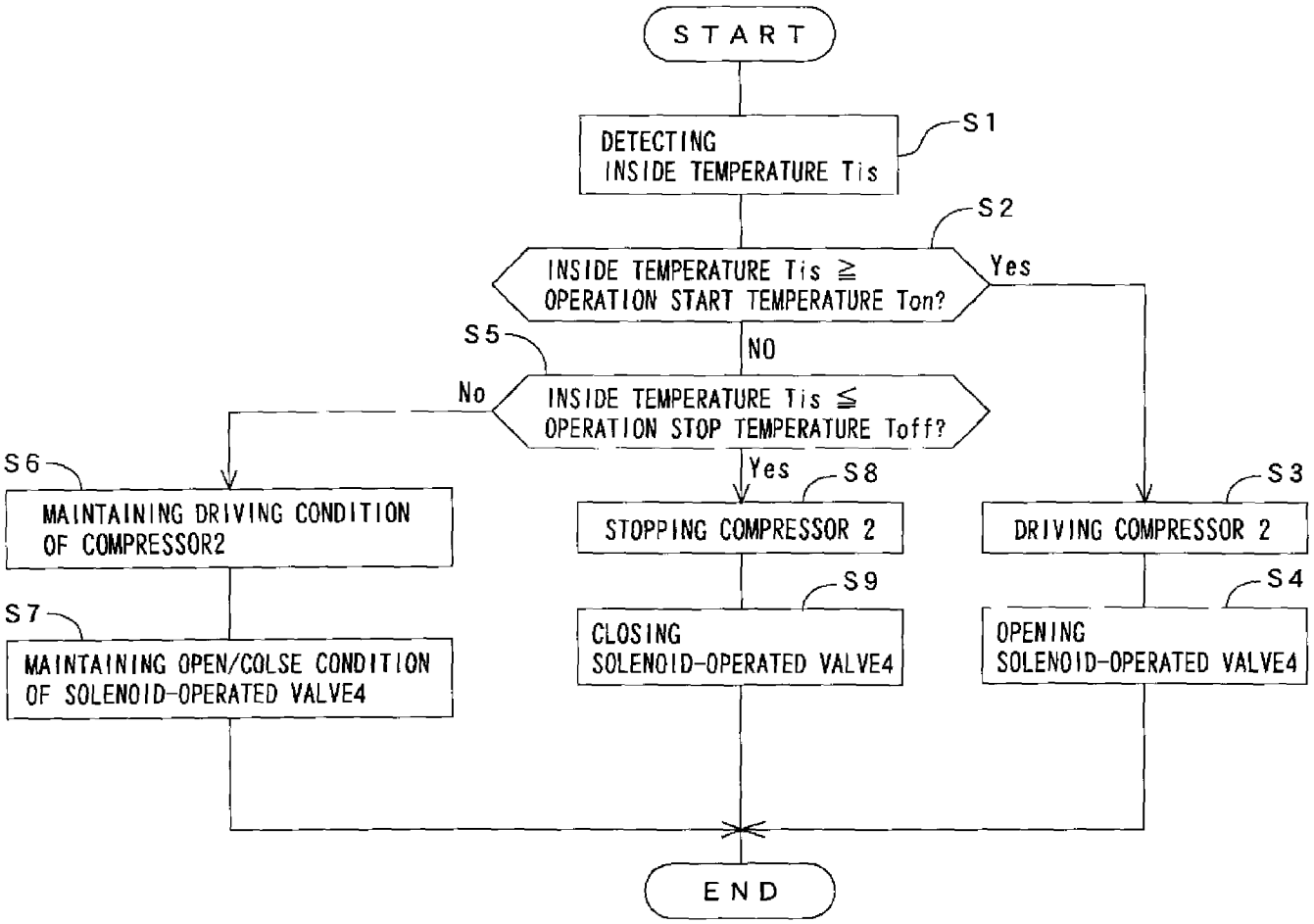
FIG. 3 is a flow chart for explaining interrupt processing of a temperature controller.

When the interrupt processing is started, the temperature controller 10, as shown in FIG. 3, takes in the inside temperature Tis detected by the inside temperature sensor 9 (Step S1), and judges whether or not the inside temperature Tis is higher or equal to the ON set temperature Ton (Step S2). At this time, for instance, in case that the inside temperature Tis tends to increase and the inside temperature Tis is higher or equal to the ON set temperature Ton (Step S2: Yes), the compressor 2 is started (Step S3). At the same time, the solenoid-operated valve 4 is opened to open the refrigerant flow passage 12*a* between the condenser 3 and the evaporator 6 (Step S4). This allows the evaporator fan 6*a* to discharge a cold blast, which cools inside the refrigeration and cold storage show case and decreases the inside temperature Tis.

After that, when the inside temperature Tis gradually decreases and the inside temperature Tis detected by the inside temperature sensor 9 becomes lower than the ON set temperature Ton (Step S2: No), the temperature controller 10 judges whether or not the inside temperature Tis is lower or equal to the OFF set temperature Toff (Step S5). As a result, in case that the inside temperature Tis is higher than the OFF set temperature Toff (Step S5: No), operation state (driving condition) of the compressor 2 at the time is maintained to sequentially decrease the inside temperature Tis. At this time, in the solenoid-operated valve 4 also, opened/closed state of the valve 4 at the time (opened state) is maintained to sequentially open the refrigerant flow passage 12*a*.

Then, when the inside temperature Tis is sufficiently decreased and the inside temperature Tis detected by the inside temperature sensor 9 becomes lower or equal to the OFF set temperature Toff (Step S5: Yes), the operation of the compressor 2 is stopped, and the solenoid-operated valve 4 is closed to close the refrigerant flow passage 12*a* as well (Steps S8, S9). This stops cooling operation of the refrigeration and cold storage show case and slowly increases the inside temperature Tis.

Afterward, the operations from Steps S1 to S9 described above are repeated at ten second intervals, and when the inside temperature Tis becomes higher or equal to the ON set temperature Ton again, operating the compressor 2 and opening the solenoid-operated valve 4 are restarted to decrease the inside temperature Tis.

Next, control operation performed by the degree-of-superheat controller 11, particularly, operation of the micro processor 13 constituting a main part of the degree-of-superheat controller 11 will be explained with reference to FIGS. 1, 2 and 4. In addition, this procession is performed at ten second intervals also, for instance, in the same manner as the control operation of the temperature controller 10 shown in FIG. 3.

Figure 4:
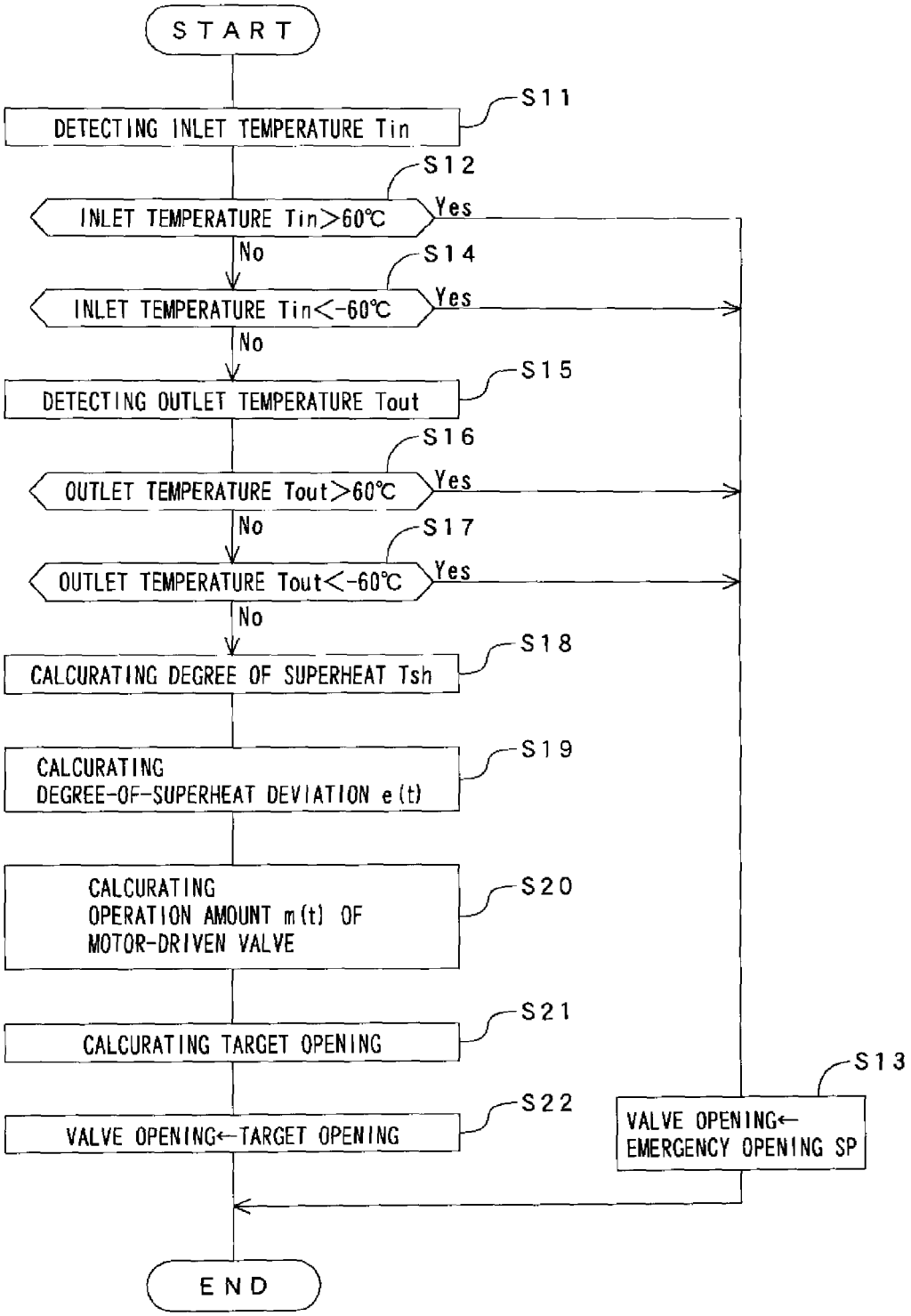
FIG. 4 is a flow chart for explaining interrupt processing of the degree-of-superheat controller.

When the interrupt processing is started, as shown in FIG. 4, the micro processor 13 of the degree-of-superheat controller 11 takes in the refrigerant temperature Tin at the inlet of the evaporator 6 (Step S11), and the degree-of-superheat controller 11 judges whether or not a value detected by the inlet temperature sensor 7 is abnormally high temperature (for example exceeding 60°) (Step S12). This judgment processing is performed to detect a short-circuit fault of the inlet temperature sensor 7, in a thermistor, as an ambient temperature increases, a resistance value thereof decreases, so that judging whether or not the detected inlet temperature Tin is abnormally high is able to confirm whether or not the resistance value of the inlet temperature sensor 7 is extremely low.

As a result of the judgment, when the inlet temperature Tin exceeds 60° (Step S12: Yes) there is a fear that a short-circuit fault occurs in the inlet temperature sensor 7, so that to the motor-driven valve 5 is outputted the motor-driven valve driving signal EV to shift the valve opening of the motor-driven valve 5 to the emergency valve opening SP, and then, the valve 5 is stopped at the emergency valve opening SP (Step S13).

Here, as described above, although the emergency valve opening SP can arbitrarily be set with the input circuit 17, the PC 23 and the others by users, in case that stoppage of cooling operation caused by the fully-closed or the fully-opened states of the motor-driven valve 5 should be avoided to precede conservation of foods preserved inside, as the emergency valve opening SP, it is preferable to set it as an intermediate value (for instance 100 to 200 pulse) between the fully-opened value and the fully-closed value. This can prevent stoppage of circulating refrigerant and liquid back, which is generated when extremely large amount of refrigerant is supplied to the evaporator 6, which allows the refrigeration cycle system 1 to continuously be operated under the condition that a certain cooling capacity is provided.

In this connection, for instance, in case that the refrigeration cycle system 1 is operated using a stand-by sensor under the condition that a temperature sensor can rapidly be repaired or replaced, as the emergency valve opening SP, it is preferable that the valve opening of the motor-driven valve 5 is set to be the fully-closed or the fully-opened value. With this, the operation of the refrigeration cycle system 1 can be stopped immediately in the stage that an abnormality occurs in the temperature sensor and the abnormality can instantaneously be informed.

On the other hand, when the inlet temperature Tin is below 60° (Step S12: No), the micro processor 13 judges whether or not the inlet temperature Tin is abnormally low (for instance below −60° (Step S14). This judgment processing is performed to detect an open-circuit fault of the inlet temperature sensor 7, and judging whether or not the detected inlet temperature Tin is abnormally low is able to confirm whether or not the resistance value of the inlet temperature sensor 7 is extremely high.

As a result of the judgment, in case that the inlet temperature Tin is lower than −60° (Step S14: Yes), in the same manner as described above, the motor-driven valve 5 is stopped at the emergency valve opening SP, in accordance with usage of the refrigeration cycle system 1, and foods inside the case is preserved and the inlet temperature sensor 7 is promoted to be repaired or replaced (Step S13).

On the other hand, in case that the inlet temperature Tin is higher or equal to −60° (Step S14: No), no abnormality is found in the inlet temperature sensor 7, so that the refrigerant temperature Tout at the outlet of the evaporator 6 is taken in (Step S15). Then, in the same manner as the inlet temperature sensor 7, the micro processor 13 judges whether or not a value detected by the outlet temperature sensor 8 is abnormally high and whether or not it is abnormally low (Steps S16, S17). As the results of the judgments, when an abnormality is found in the outlet temperature sensor 8, the valve opening of the motor-driven valve 5 is shifted to the emergency valve opening SP, and the valve 5 is stopped at the emergency valve opening SP (Step S13).

On the contrary, when no abnormality is found in the outlet temperature sensor 8, a normal control operation of the valve opening is started; the present degree of superheat Tsh (=Tout−Tin) is calculated; and a deviation e(t) (=Ts−Tsh) between a set degree of superheat (target value of the degree of superheat Tsh) and the present degree of superheat is calculated (Steps S18, S19) as well. Next, based on a set of the deviation e in the past, the proportional band PB, the integration time Ti and the derivative time Td, the operation amount m(t) of the valve opening at this time is calculated with a PID (proportional, integral and differential) calculation in accordance with the following formula 1 (Step S20). Here, Kp is a proportional gain.

$$M(t)=K_p\{e(t)+1/T_i\int e(t)dt+T_d de(t)/dt\} \quad \text{[Formula 1]}$$

where, $K_p$=100/PB

Then, the target valve opening of the motor-driven valve 5 is calculated based on the calculated operation amount m(t) (Step S21), and the degree-of-superheat controller 11 sets the number of driving pulses such that the valve opening of the motor-driven valve 5 becomes the target valve opening, and outputs the motor-driven valve driving signal EV to the motor-driven valve 5 to increase/decrease the valve opening of the valve 5 (Step S22).

Figure 5:
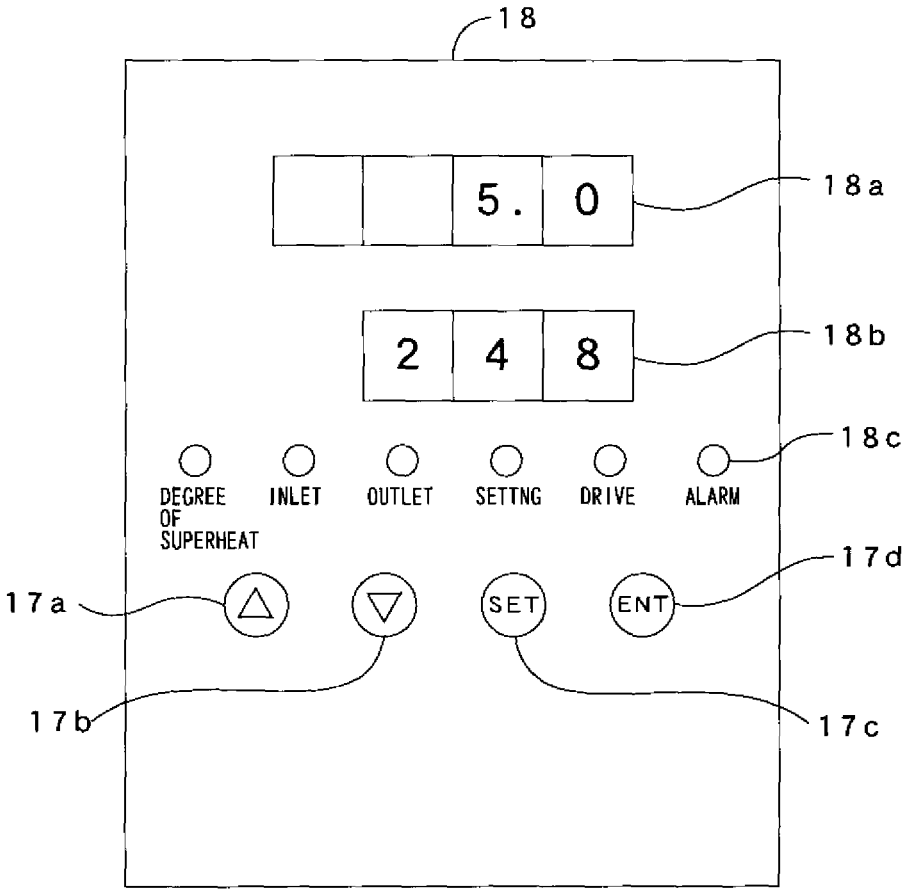
FIG. 5 is an appearance diagram showing surface of a main body of the degree-of-superheat controller.

Next, the whole stream of inputting (changing) operation of each setting value with the input circuit 17 and the display circuit 18 shown in FIG. 2 will be explained with reference to FIG. 5 and Table 1. Meanwhile, FIG. 5 is an appearance diagram showing surface of a main body of the degree-of-superheat controller 11.

For instance, under the condition that a temperature and the present valve opening are respectively displayed on the temperature displaying element 18*a* and the valve opening displaying element 18*b*, depressing the set switch 17*c* enters the setting mode, and the temperature displaying element 18*a* shifts from a temperature display mode to a setting value display mode, and the valve opening displaying element 18*b* switches display from the present valve opening to a setting item.

The setting value (numerical number) displayed on the temperature displaying element 18*a* can be increased/decreased by depressing the up switch 17*a* or the down switch 17*b*, and depressing the enter switch 17*d* allows the displayed setting value to be renewed and stored as a new setting value.

On the other hand, the setting items are, for example as shown in Table 1, nine in number, and on the valve opening displaying element 18*b* is displayed a setting value number and a symbol, for instance, "1. HV". This setting item is, in the setting mode, by depressing the set switch 17*c*, sequentially switched to the next one, and when the setting item 9 ("8. SP") is displayed, depressing the set switch 17*c* quits the setting mode and returns to the condition that temperature and valve opening are displayed.

TABLE 1

| No. | SIGNAL | SETTING ITEM | MINIMUM VALUE | MAXIMUM VALUE | UNIT |
|---|---|---|---|---|---|
| 0. | SH | DEGREE OF SUPERHEAT | 1 | 30 | ° C. |
| 1. | HV | UPPER LIMIT OPENING | 1 | 500 | pulse |
| 2. | LV | LOWER LIMIT OPENING | 0 | 499 | pulse |
| 3. | P | P | 1 | 100 | % |
| 4. | i | I | 1 | 5000 | second |
| 5. | d | D | 0 | 5000 | second |
| 6. | SV | STARTING OPENING | 0 | 500 | pulse |
| 7. | St. | STARTING TIME | 0 | 1200 | second |
| 8. | SP | EMERGENCY VALVE OPENING | 0 | 500 | pulse |

Meanwhile, various setting values shown in the Table. 1, as described above, can be set and changed by operations from the PC 23 utilizing communication also.

Figure 6:
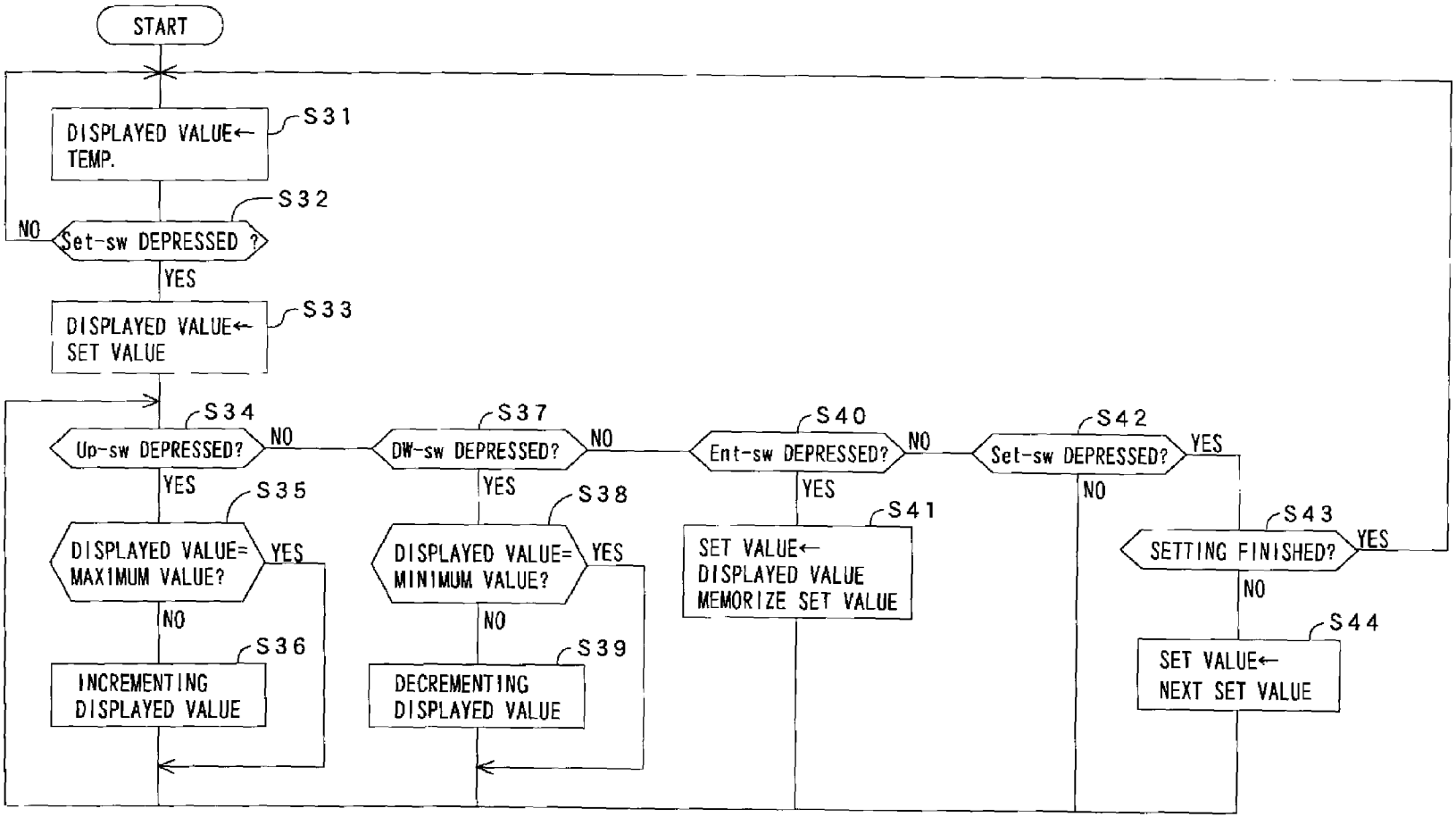
FIG. 6 is a flow chart for explaining operations of inputting and changing a setting value.

Next, inputting (changing) operation of each setting value with the input circuit 17 and the display circuit 18 will be explained with reference to FIGS. 5, 6.

When displaying a temperature on the temperature displaying element 18*a* (Step S31), in Step S32, whether or not the set switch 17*c* is depressed is judged, and when depressed, in Step S33, on the temperature displaying element 18*a* is displayed a setting value, and on the valve opening displaying element 18*b* is displayed a number and a symbol corresponding to the setting value as well, and it enters the setting mode, when the set switch 17*c* is not depressed it returns to the condition of Step S31.

Next, in Step S34, whether or not the up switch 18*a* is depressed is judged, when depressed, in Step S35, whether or not displayed value on the temperature displaying element 18*a* is the maximum value of the setting value is judged. As a result of the judgment, when the displayed value is not the maximum value of the setting value, in Step S36, the displayed value is incremented and it returns to Step S34. On the other hand, when the displayed value is the maximum value of the setting value, it returns to Step S34 as it is.

In Step S34, when the up switch 17*a* is judged not to be depressed, in Step S37, whether or not the down switch 17*b* is depressed is judged, when depressed, in Step S38, whether or not the displayed value is the minimum value of the setting value is judged, when the displayed value is not the minimum value of the setting value, in Step S39, the displayed value is decremented and it returns to Step S34. On the other hand, when the displayed value is the minimum value of the setting value it returns to Step S34 as it is.

In Step S37, when the down switch 17*b* is judged not to be depressed, in Step S40, whether or not the enter switch

17*d* is depressed is judged, when depressed, in Step S41, the setting value is renewed to the present displayed value, and the renewed setting value is stored in the memory circuit 20 of FIG. 2, and it returns to Step S34.

When the enter switch 17*d* is not depressed in Step S40, in Step S42, whether or not the set switch 17*c* is depressed is judged, when judged not to be depressed, it returns to Step S34.

In Step S42, when the set switch 17*c* is judged to be depressed, in Step S43, whether or not the setting is finished is judged. Concretely, in Step S42, under the condition that the setting item 9 "emergency valve opening" is displayed, when the set switch 17*c* is depressed the setting mode is judged to be finished in Step S43, and it returns to Step S31.

On the other hand, in Step S42, under the condition that an item other than the setting item 9 "emergency valve opening" is selected, when the set switch 17*c* is depressed, in Step S44, the next setting value is displayed on the temperature displaying element 18*a*; a number and a symbol corresponding to the next setting are displayed on the valve opening displaying element 18*b*; it returns to Step S34; and the above motions are repeated.

The above operations are able to input (change) each setting value, and the emergency valve opening SP can freely be set also. In addition, the emergency valve opening SP can freely be set also after it was set once, further, the set emergency valve opening SP can be changed not only during the stoppage of the refrigeration cycle system 1 but also during the operation of the system 1.

As described above, with the present embodiment, as the emergency valve opening SP of the motor-driven valve 5, intermediate valve opening values excluding those in the fully-opened and fully-closed states can be set, in addition to that, in case that an abnormality occurs in the inlet and outlet temperature sensors 7, 8, the motor-driven valve 5 is stopped at the set emergency valve opening SP, so that even if an abnormality occurs in the sensors 7, 8, stoppage of the refrigeration cycle system 1 due to a low-pressure abnormality and liquid back can be avoided. This can continue cooling operation inside the case until a maintenance worker arrives, which prevents bruised foods even if swift repair is impossible.

Further, since the emergency valve opening SP can freely be changed, the emergency valve opening SP can be set in accordance with usage of the refrigeration cycle system 1 and user's request thereto, for instance, besides the control specifying the valve opening to the intermediate valve opening values, a control intentionally stop the system 1 is also selectable. This can increase degree of freedom in selecting motion of the motor-driven valve 5, and improve versatility and convenience of the refrigeration cycle system 1.

In addition, in the present embodiment described above, although the case that an abnormality occurs in the inlet and outlet temperature sensors 7, 8 is exemplified, the present invention can be applied to a sensor detecting a temperature at the valve opening control of the motor-driven valve 5 other than the inlet and outlet temperature sensors 7, 8, moreover, the present invention can be applied also when an abnormality occurs in a pressure sensor detecting pressure of the refrigerant circulating in the refrigeration cycle.

Figure 7:
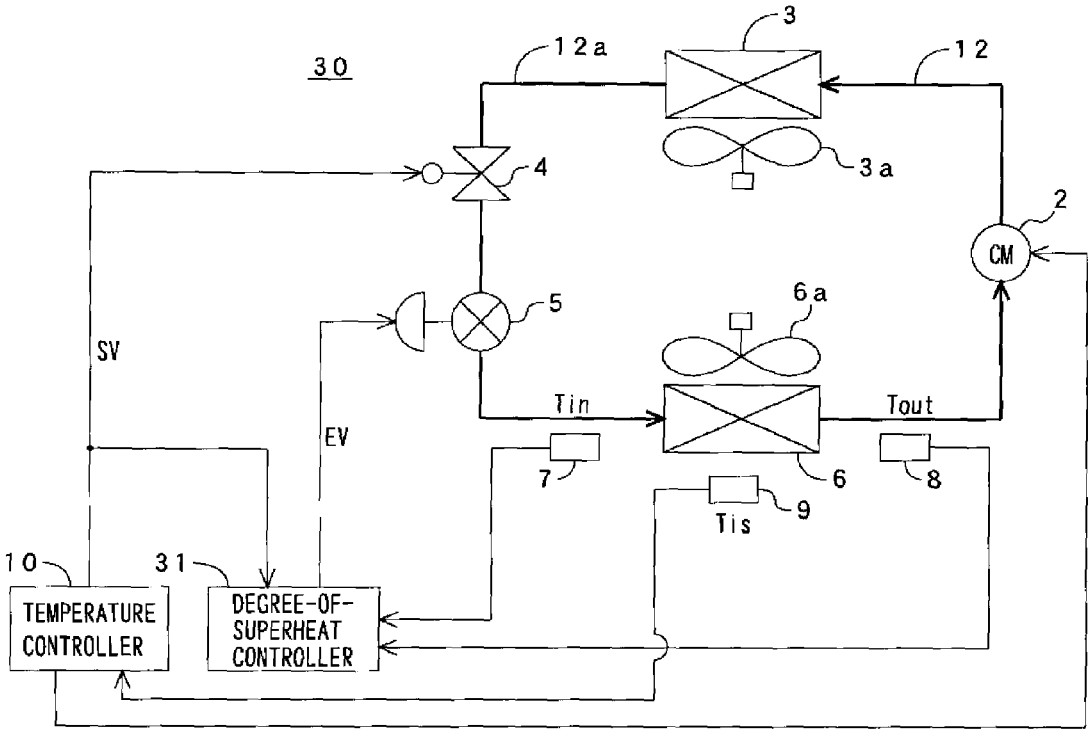
FIG. 7 is a drawing showing the construction of an example of a refrigeration cycle system with a valve controller according to the second embodiment of the present invention.
Figure 8:
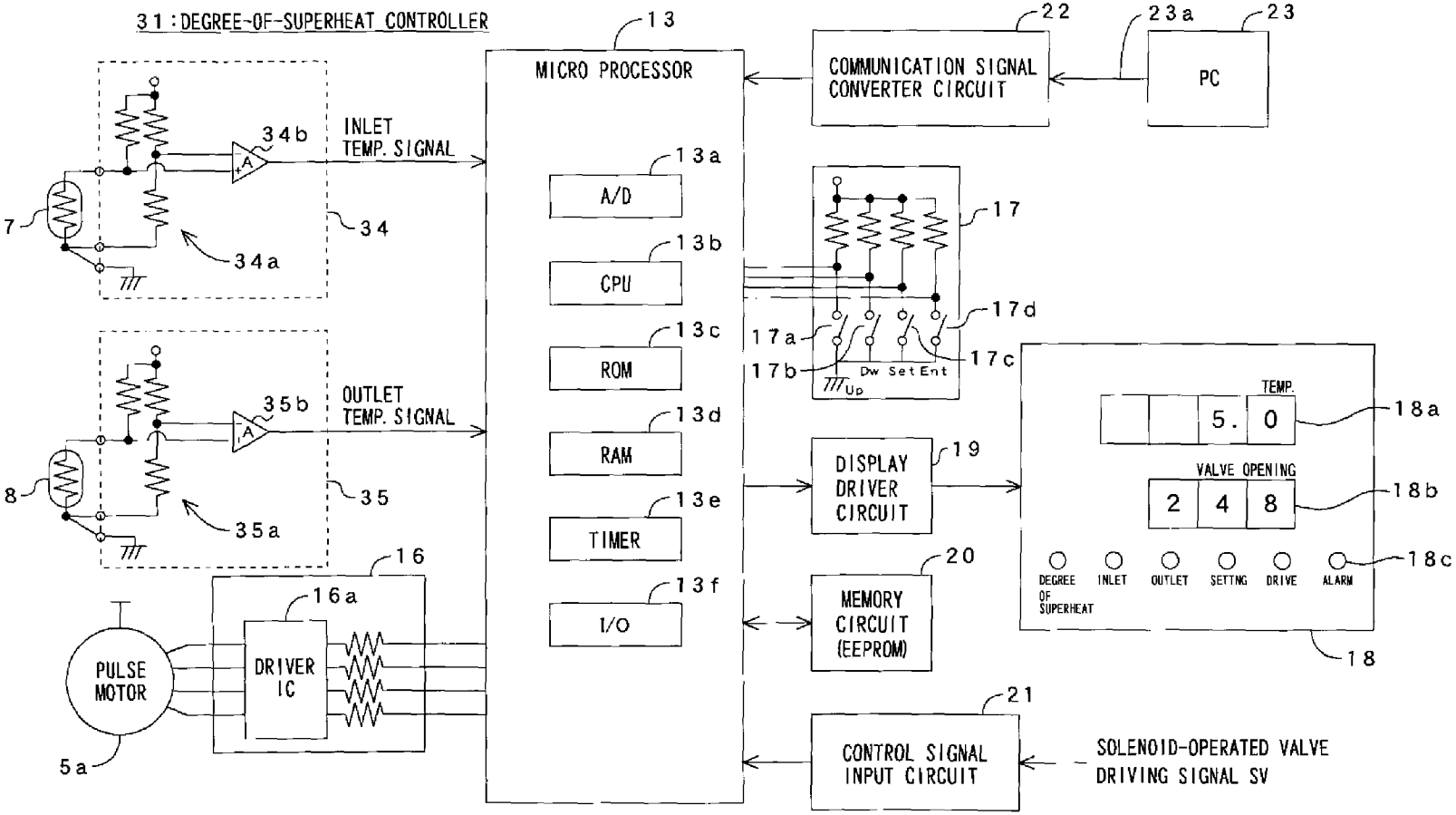
FIG. 8 is a block diagram showing a degree-of-superheat controller shown in FIG. 7 and peripheral circuits around the controller in detail.

Next, a valve controller according to the second embodiment of the present invention will be explained with reference to FIGS. 7 to 11. In FIGS. 7, 8, like symbols are applied to like constituents shown in FIGS. 1, 2, and detailed explanation thereof will be omitted.

Further, in the present embodiment also, as a refrigeration cycle system is exemplified a system for controlling temperature inside a refrigeration and cold storage showcase used for cold reserving and displaying foods, in addition, the valve controller of the present invention is exemplarily used for a device for controlling an electric expansion valve (motor-driven valve) disposed in the above refrigeration cycle system described above.

FIG. 7 shows the refrigeration cycle system with the valve controller according to the second embodiment, and the system 30 is provided with the compressor 2, the condenser 3, the condenser fan 3*a*, the solenoid-operated valve 4, the motor-driven valve 5, the evaporator 6, the evaporator fan 6*a*, the inlet temperature sensor 7, the outlet temperature sensor 8, the inside temperature sensor 9, the temperature controller 10 and a degree-of-superheat controller 31.

The degree-of-superheat controller 31 is a control circuit for controlling valve opening of the motor-driven valve 5, and is constructed by a microcomputer and peripheral circuits for instance. This controller 31 calculates valve opening of the motor-driven valve 5 through PID control based on the degree of superheat Tsh of the refrigerant in the evaporator 6 (Tsh=the temperature Tout detected by the outlet temperature sensor 8−the temperature Tin detected by the inlet temperature sensor 7), and outputs the motor-driven valve driving signal EV corresponding to the calculated valve opening to the pulse motor of the motor-driven valve 5.

In addition, the degree-of-superheat controller 31 has functions of detecting opened/closed states of the solenoid-operated valve 4 by monitoring a voltage level of the solenoid-operated valve driving signal SV, and switching presence/absence of an output of the motor-driven valve driving signal EV to the motor-driven valve 5 in accordance with the opened/closed states of the solenoid-operated valve 4. Further the controller 31 has a function of controlling an initialization processing of the motor-driven valve 5 also, and controls execution timings of the initialization processing (hereinafter called as "initialization timing") in accordance with opening/closing timings of the solenoid-operated valve 4 and time measured by a timer described below.

Meanwhile, a setting value determining the initialization timing (initialization time It), in the same manner as "the emergency valve opening SP" in the first embodiment, can be inputted with the input circuit 17, or inputted by operating the PC 23 through the communication signal conversion circuit 22. Further, specific input and change operations of the initialization time It are performed in the same manner as shown in FIGS. 5 and 6.

The degree-of-superheat controller 31 is, as shown in FIG. 8, provided with the micro processor 13, an inlet temperature detecting circuit 34, an outlet temperature detecting circuit 35, the motor-driven valve driving circuit 16, the input circuit 17, the display circuit 18, the display driver circuit 19, the memory circuit (EEPROM) 20, the control signal input circuit 21 and the communication signal conversion circuit 22.

The inlet temperature detecting circuit 34 is a resistance-voltage conversion circuit for converting a resistance value of the inlet temperature sensor 7 to a DC-voltage signal and outputting it to the micro processor 13. In order to accurately detect the temperature Tin of a refrigerant at the inlet of the evaporator 6, this inlet temperature detecting circuit 34 is constructed by a bridge circuit 34*a* and an amplifying circuit 34*b* for amplifying a voltage between intermediate terminals of the bridge circuit 34*a*.

The outlet temperature detecting circuit 35 is a resistance-voltage conversion circuit for converting a resistance value of the outlet temperature sensor 8 to a DC-voltage signal and outputting it to the micro processor 13. This outlet temperature detecting circuit 35 is also constructed by a bridge circuit 35*a* and an amplifying circuit 35*b* to accurately detect the temperature Tout of a refrigerant at the outlet of the evaporator 6.

Next, the operation of the refrigeration cycle system 30 with the construction described above will be explained.

The interrupt processing performed by the temperature controller 10 is carried out in the same manner as the first embodiment, and the routine shown in the FIG. 3 while using a timer (not shown) and the like is performed at predetermined intervals (every ten seconds, as an example).

Next, a control operation performed by the degree-of-superheat controller 31, particularly, operation of the micro processor 13 constituting a main part of the controller 31 will be explained. Here, at first, management processing of the initialization timing will be explained with reference to FIGS. 7 to 9. Meanwhile, this procession is different from the control operation of the temperature controller 10 shown in FIG. 3, and is continuously performed while the refrigeration cycle system 30 is in operation.

Figure 9:
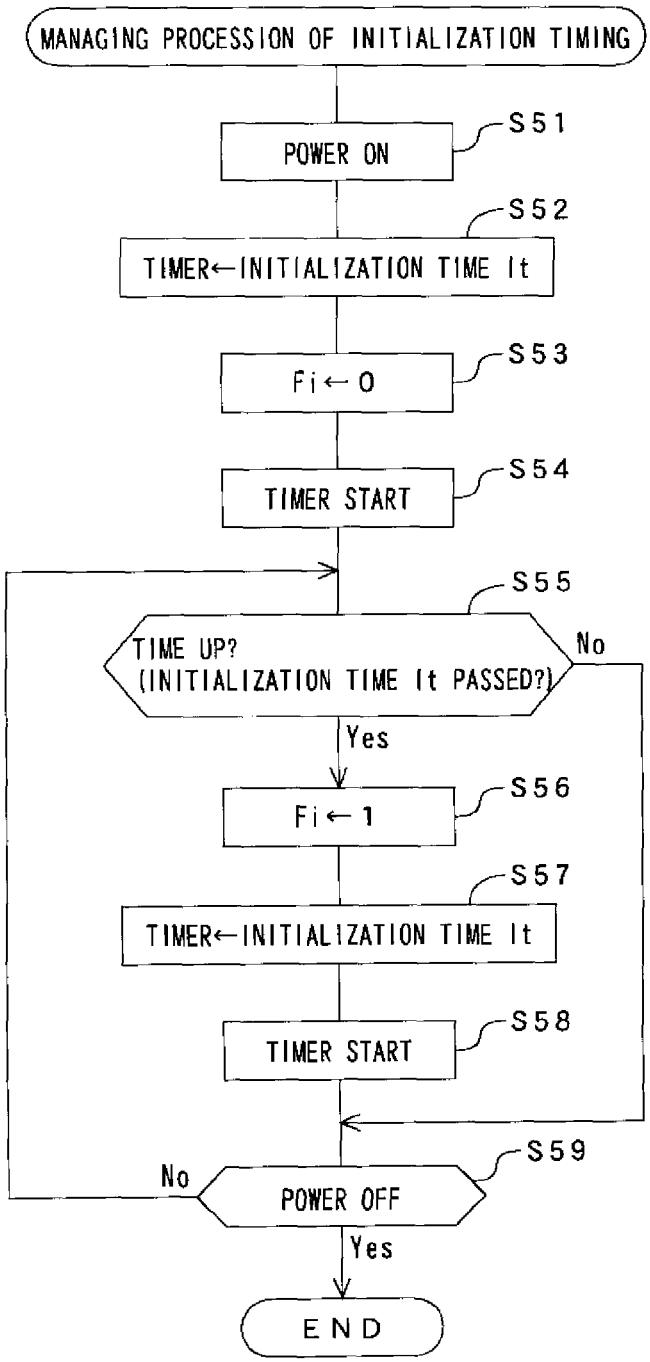
FIG. 9 is a flow chart for explaining a managing procession of initialization timing.

As shown in FIG. 9, when power is supplied to start operation of the refrigeration cycle system 30 (Step S51), the micro processor 13 sets the initialization time It, which is set by the input circuit 17 or the PC 23, to a start value (at a down count) of the timer 13*e* (Step S52).

Next, an initialization flag Fi is cleared (set it to "0") (Step S53), and the down count of the timer 13*e* is started as well (Step S54). Here, the initialization flag Fi shows necessity of the initialization processing of the motor-driven valve 5, and in case that the value of the flag Fi is "1", the flag Fi shows that the initialization processing should be carried out, and in case that the value of the flag Fi is "0", which means the initialization processing is not required.

After that, the down count is continued until the count value of the timer 13*e* reaches to "0" (Step S55), and when the count value reaches to "0" (time up) (Step S55: Yes), the initialization flag Fi is set to be "1" (Step S56). Then, the initialization time It is set to the start value of the timer 13*e* again (Step S57), and the down count of the timer 13*e* is started (Step S58).

Hereinafter, until a power source is turned off to stop the operation of the refrigeration cycle system 30, the processes in the Steps S55 to S58 are repeated (Step S59) to continuously manage the initialization timing.

Next, an interrupt processing performed by the degree-of-superheat controller 31 will be explained with reference to FIGS. 7, 8 and 10. Meanwhile, this procession is carried out in synchronization with the control operation of the temperature controller 10 at ten second intervals, for instance, in the same manner as the control operation of the temperature controller 10 thereof shown in FIG. 3.

Figure 10:
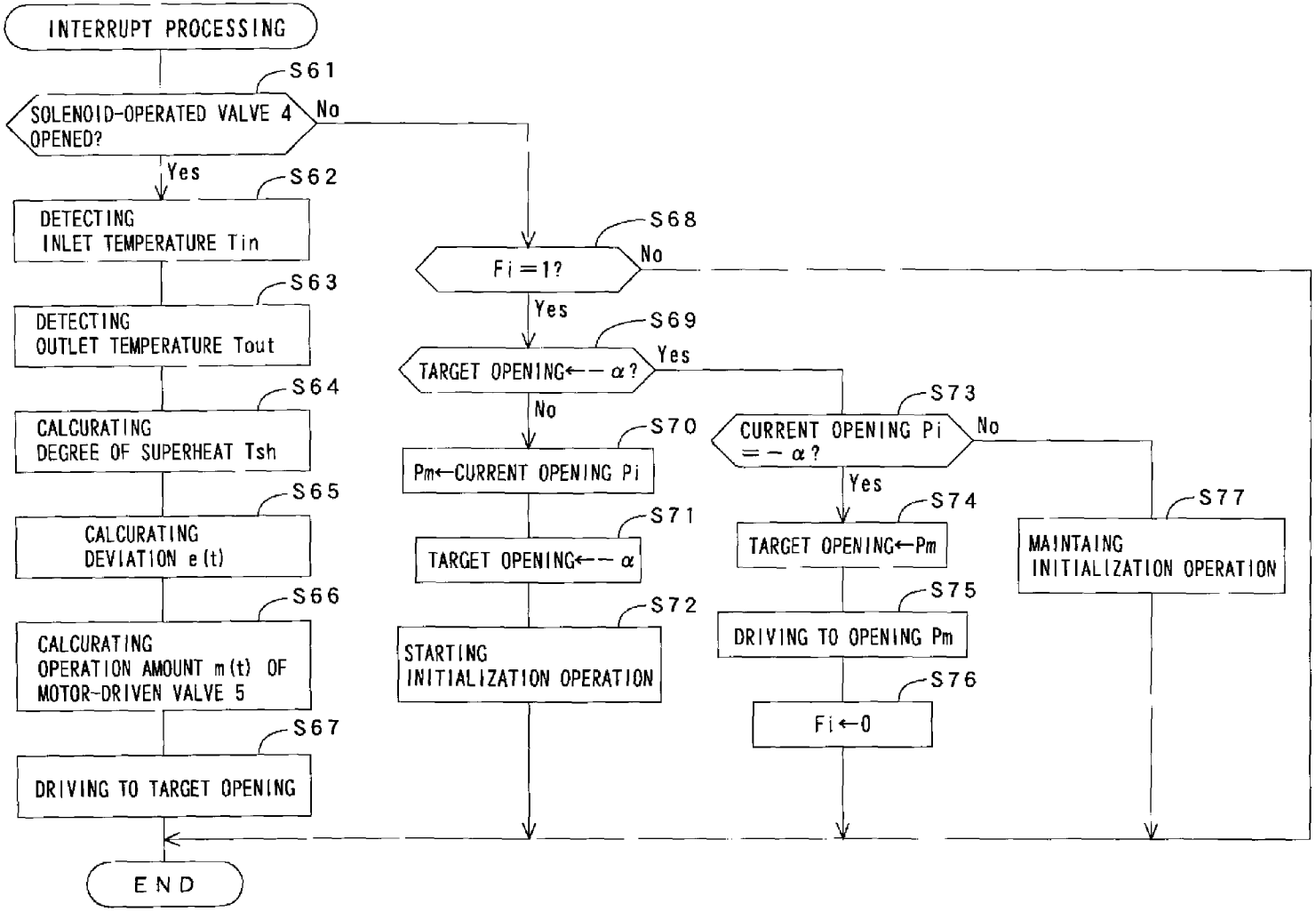
FIG. 10 is a flow chart for explaining interrupt processing of the degree-of-superheat controller.

When the interrupt processing is started, as shown in FIG. 10, the micro processor 13 of the degree-of-superheat controller 31 judges whether or not the solenoid-operated valve 4 is opened with reference to opening/closing signals (a convert signal of the solenoid-operated valve driving signal SV) outputted from the control signal input circuit 21 (Step S61). As a result of the judgment, in case that the valve 4 is opened (Step S61: Yes), the degree-of-superheat controller 31 takes in refrigerant temperatures Tin, Tout at the inlet and outlet of the evaporator 6 respectively (Steps S62 and S63) to calculate the present degree-of-superheat Tsh (=Tout−Tin) (Step S64).

Next, a deviation e(t) (=Ts−Tsh) between a set degree-of-superheat (target value of the degree of superheat Tsh) Ts and the present degree-of-superheat Tsh is calculated (Step S65), and based on a set of the deviation e in the past, the proportional band PB, the integration time Ti and the derivative time Td, the operation amount m(t) of the valve opening at this time is calculated with a PID (proportional, integral and differential) calculation in accordance with the above formula 1 (Step S66).

This calculates a target valve opening that the motor-driven valve 5 should reach to, and the degree-of-superheat controller 31 specifies the number of driving pulses such that a valve opening of the valve 5 becomes the target valve opening, and outputs the motor-driven valve driving signal EV to the valve 5 to increase/decrease the valve opening of the valve 5 (Step S67).

On the other hand, as a result of the above judgment in Step S61, in case that the solenoid-operated valve 4 is closed (Step S61: No), the micro processor 13 judges whether or not the initialization flag Fi is set to be "1" (Step S68). As the result, in case that the initialization flag Fi is set to be "0" (Step S68: No), any procession is not performed, and changing the valve opening of the motor-driven valve 5 and the like are not carried out.

On the contrary, in case that the initialization flag Fi is set to be "1" (Step S68: Yes), the micro processor 13 judges whether or not the target valve opening of the motor-driven valve 5 is set to be a −α pulse (Step S69). Here, "−α pulse" is a valve opening value to allow the motor-driven valve 5 to be driven in a closing direction and to be in the fully-closed state. Meanwhile, although a valve opening value in the fully-closed state is usually 0 pulse, the target valve opening value is set to be −α pulse (minus value). This is because in view of catching of a foreign matter or the like, to the valve opening value in the fully-closed state (0 pulse) is added a margin of a few pulses (approximately 8 pulses as an example) in a direction that the valve 5 closes (see FIG. 11 (*g*)). In addition, in the Step S69, the reason why the micro processor 13 judges whether or not the target valve opening is set to −α pulse is to judge whether or not the initialization processing of the valve 5 has already been started.

In the case described above, for example, when the initialization processing of the motor-driven valve 5 has not yet been started, and the target valve opening of the valve 5 is set to the valve opening calculated in the Steps S66, S67 (Step S69: No), it moves to Step S70, and the valve opening Pi of the valve 5 at the time is memorized to the RAM 13*d* inside the micro processor 13 as a valve opening Pm just before the initialization processing is performed. Next, the target valve opening of the valve 5 is set to −α pulse (Step S71), and the initialization processing is started (Step S72).

Under the condition, when an interrupt time (ten seconds) passes, the micro processor 13 judges whether or not the target valve opening of the motor-driven valve 5 is set to be −α pulse again (Step S69). At this moment, since the initialization processing of the motor-driven valve 5 has already been started, it moves to Step S73, and the micro processor 13 judges whether or not the valve opening Pi of the valve 5 at the moment is set to be −α pulse. Meanwhile, the reason why the judgment processing in Step S73 is performed is to judge whether or not the initialization processing started in Step S72 is finished.

Then, in case that the valve opening Pi reaches to the −α pulse after the initialization processing is finished (Step S73: Yes), the target valve opening of the motor-driven valve 5 is set to be the valve opening Pm memorized in the RAM 13*d* in the previous Step S70 described above (Step S74). Next, the valve 5 is driven (Step S75), and the initialization flag Fi is set to be "0" (Step S76).

In this connection, when the initialization processing has not yet been finished and the valve opening Pi of the motor-driven valve 5 has not reached to −α pulse at the judgment processing in the Step S73 (Step S73: No), the initialization processing is continued (Step S77).

Next, an example of operation of the refrigeration cycle system 30 under the control shown in FIGS. 3, 9 and 10 will be explained with reference to FIG. 11. Here, the initialization time It shall be set to be 168 hours (24 hours×7(=one week)). In addition, operation of the refrigeration cycle system 30 is started at the time earlier than the timing t1 shown in FIG. 11, and the clear processing of the initialization flag Fi and the count start of the timer 13*e* at the power-supply shall have been already started.

Figure 11:
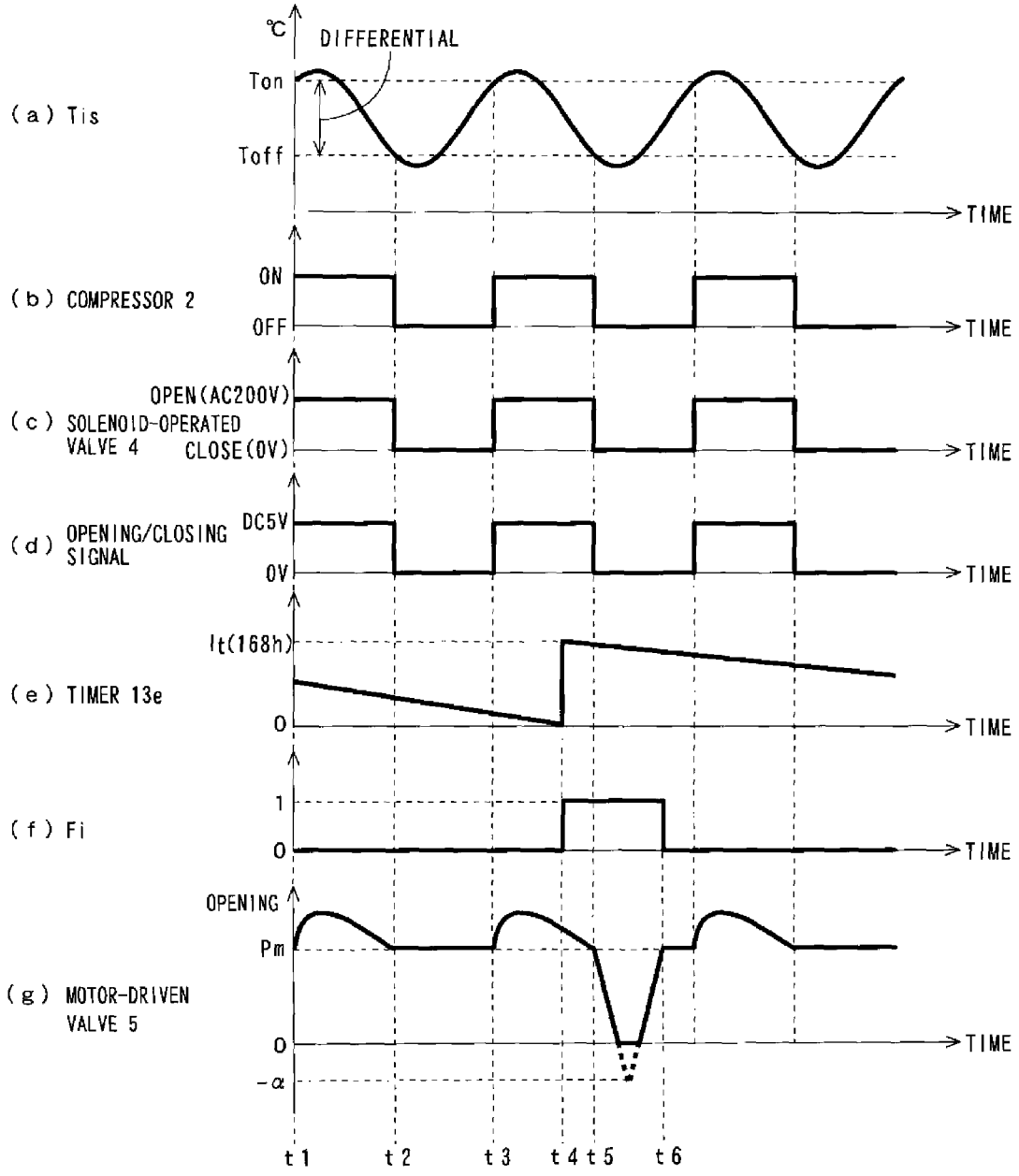
FIG. 11 is a timing diagram showing an example of the operation of the refrigeration cycle system under control shown in FIGS. 3, 9 and 10.

As shown in the FIG. 11, in the timing t1, when the inside temperature Tis becomes higher or equal to the ON set temperature Ton, the compressor 2 is operated and the solenoid-operated valve 4 is opened to open the refrigerant flow passage 12*a*. Further, in response to the opening the solenoid-operated valve 4, the opening/closing signal (control signal) becomes DC-5V, which starts the valve opening adjustment of the motor-driven valve 5 based on a PID calculation so as to adjust flow rate of a refrigerant circulating in the refrigeration cycle. The operation of the compressor 2, the opening of the solenoid-operated valve 4 and the valve opening adjustment of the motor-driven valve 5 are continuously performed until the inside temperature Tis is higher than the OFF set temperature Toff even if the inside temperature Tis becomes lower or equal to the ON set temperature Ton.

Then, the temperature inside the refrigeration and cold storage show case decreases, and in the timing t2, when the inside temperature Tis reaches to the OFF set temperature Toff, the operation of the compressor 2 is stopped and the solenoid-operated valve 4 is closed to close the refrigerant flow passage 12*a*. In addition, in response to the closing the solenoid-operated valve 4, the opening/closing signal (control signal) becomes 0V, which stops outputting the motor-driven valve driving signal EV to the motor-driven valve 5 (the number of driving pulses is set to be zero) and suspends the valve opening adjustment of the valve 5. As a result, the valve opening of the motor-driven valve 5 remains as that at the stopping of the valve opening adjustment, hereinafter, until the valve opening adjustment is restarted, the condition is maintained.

After that, the temperature inside the refrigeration and cold storage show case increases, and in the timing t3, when the inside temperature Tis reaches to the ON set temperature Ton again, the operation of the compressor 2 is restarted and the solenoid-operated valve 4 is opened. At this moment, the opening/closing signal (control signal) becomes DC-5V also, which restarts the valve opening adjustment of the motor-driven valve 5, however, the valve opening of the valve 5 at the restarting remains as that at the stoppage of the valve opening adjustment (in the timing t2), so that increase/decrease of the valve opening of the valve 5 after restarting the operation of the compressor 2 starts from the valve opening at the stoppage of the valve opening adjustment.

Therefore, the operation amount of the motor-driven valve 5 in the above case is calculated by deducting the valve opening at the stoppage of the valve opening adjustment from the target valve opening calculated by the PID operation, so that, for instance, the operation amount of the motor-driven valve 5 can considerably be decreased in comparison to a case when shifted to a target valve opening from the fully-closed state. As a result, it is possible to keep the number of driving pulses of the motor-driven valve driving signal EV small to make the operation amount of the motor-driven valve 5 small, resulting in longer life of the valve 5.

Next, in the timing t4, when 168 hours passes after starting count with the timer 13*e* and the count value of the timer 13*e* reaches to "0", the initialization flag Fi is set to be "1", which sets that initialization of the motor-driven valve 5 shall be carried out.

After that, in the timing t5, the inside temperature Tis decreases and the temperature Tis becomes lower or equal to the OFF set temperature Toff the operation of the compressor 2 is stopped and the solenoid-operated valve 4 is closed. In response to this, the opening/closing signal (control signal) becomes 0V, which leads a period that the valve control of the motor-driven valve 5 stops, so that in the motor-driven valve 5, the initialization processing is started to determine the position of the valve body. Meanwhile, although the target valve opening when performing the initialization processing is set to be −α pulse as described above, the valve body of the motor-driven valve 5 contact with a stopper (not shown) provided inside the motor-driven valve 5 when reaching to the fully-closed position, so that motion of the valve body is mechanically restricted, and the valve body does not move any more in a direction that the valve 5 closes.

Then, when the initialization processing is finished, after that, in the timing t6, the valve opening of the motor-driven valve 5 is changed to that just before performing the initialization processing, and the initialization flag Fi is set to be "0" as well.

Hereinafter, while the refrigeration cycle system 30 is in operation, the same operation is repeated, that is, the initialization processing of the motor-driven valve 5 is performed each time that the initialization flag Fi is set to be "1" and the solenoid-operated valve 4 is closed.

In addition, in the operation exemplified above, the solenoid-operated valve 4 is closed after the time measured by the timer 13*e* reaches to the initialization time It (see the timings t4, t5), so that the initialization processing of the motor-driven valve 5 is performed after the solenoid-operated valve 4 is closed, on the other hand, in case that the solenoid-operated valve 4 is closed, reaching the time measured by the timer 13 to the initialization time It allows the initialization processing to instantly be carried out.

As described above, in the present embodiment, the initialization time It can be set, in addition to that, each time that the time measured by the timer 13*e* reaches to the initialization time It the initialization processing of the motor-driven valve 5 is performed, so that not only at the power-up but after that, the initialization processing can periodically be carried out. As a result, even when a difference in valve opening caused by catching of a foreign substance or the like is generated in operation of the refrigeration cycle system 30, the difference can periodically be modified, which allows the valve opening of the motor-driven valve 5 to accurately be controlled. Therefore, it is possible to prevent failures such as leakage of a refrigerant beforehand, consequently, the reliability of the refrigeration and cold storage system can be improved.

In addition, the initialization processing of the motor-driven valve 5 is performed only when the refrigerant flow passage 12*a* is closed after the solenoid-operated valve 4 is closed and the valve opening control of the motor-driven valve 5 through PID control is stopped, so that even while the refrigeration cycle system 30 is in operation, it is possible to perform the initialization processing without harmful affects to the motor-driven valve 5 and other devices connected with the motor-driven valve 5 (the compressor 2 and the like). Therefore, it is unnecessary to stop the refrigeration cycle system 30 for the initialization processing, which allows hindrance to the operation of the refrigeration cycle system 30 to be avoided and complexity accompanying the operation to be eliminated.

Figure 12:
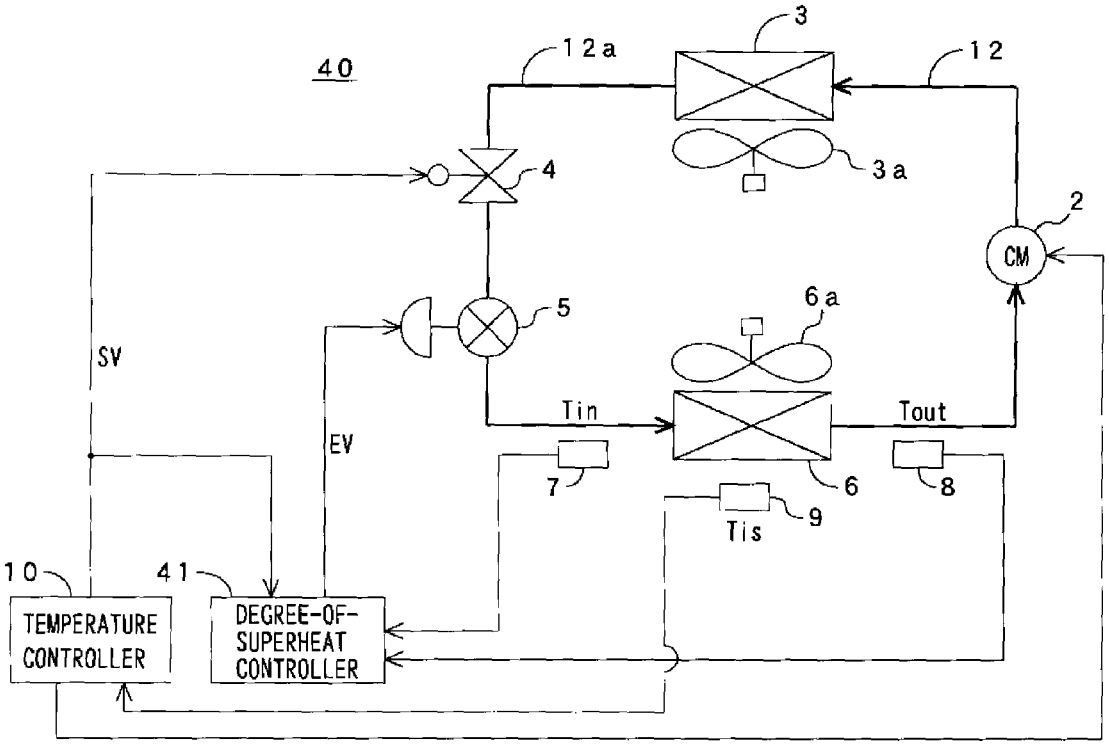
FIG. 12 is a drawing showing the construction of a refrigeration and cold storage system according to the third embodiment of the present invention.

Next, a refrigeration and cold storage system and a controller of the system according to the third embodiment of the present invention will be explained with reference to FIGS. 12 to 14. In FIG. 12, to the same constituent factors as those in FIG. 1 are attached the same symbols, and explanations thereof will be omitted. And, in the following explanation, the refrigeration and cold storage system according to the present invention is exemplarily applied to a refrigeration and cold storage showcase used for cold reserving and displaying foods, and the like.

FIG. 12 shows the refrigeration and cold storage system according to the third embodiment of the present invention, this system 40 is provided with the compressor 2, the condenser 3, the condenser fan 3*a*, the solenoid-operated valve 4, the motor-driven valve (motor-driven expansion valve) 5, the evaporator 6, the evaporator fan 6*a*, the inlet temperature sensor 7, the outlet temperature sensor 8, the inside temperature sensor 9, the temperature controller 10, and a degree-of-superheat controller 41.

The degree-of-superheat controller 41 is a control circuit for controlling valve opening of the motor-driven valve 5, and is constructed by a microcomputer and peripheral circuits for instance. This controller 41 calculates valve opening of the motor-driven valve 5 through PID control based on the degree of superheat Tsh of the refrigerant in the evaporator 6 (Tsh=the temperature Tout detected by the outlet temperature sensor 8−the temperature Tin detected by the inlet temperature sensor 7), and outputs the motor-driven valve driving signal EV corresponding to the calculated valve opening to the pulse motor of the motor-driven valve 5.

In addition, the degree-of-superheat controller 41 has functions of detecting opened/closed state of the solenoid-operated valve 4 by monitoring a voltage level of the solenoid-operated valve driving signal SV, and switching presence/absence of an output of the motor-driven valve driving signal EV to the motor-driven valve 5 in accordance with the opened/closed state of the solenoid-operated valve 4.

Next, the operation of the refrigeration and cold storage system 40 with the above-mentioned construction will be explained.

Interrupt processing by the temperature controller 10 is carried out in the same manner as the first embodiment, and the routine shown in the FIG. 3 while using a timer (not shown) and the like is performed at predetermined intervals (every ten seconds, as an example).

Next, control operation performed by the degree-of-superheat controller 41 will be explained with reference to FIGS. 12, 13. The degree-of-superheat controller 41 operates in synchronization with the operation of the temperature controller 10, and in the same manner as the controller 10, for instance, the degree-of-superheat controller 41 performs a routine shown in the FIG. 13 every ten seconds, as an example.

Figure 13:
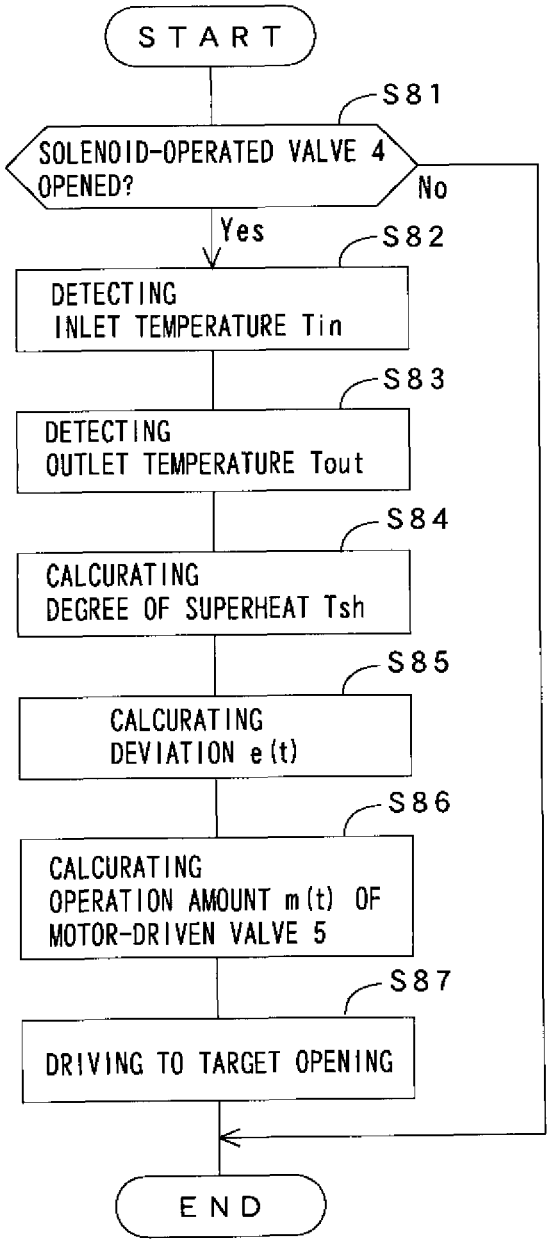
FIG. 13 is a flow chart for explaining control operation of a degree-of-superheat controller shown in FIG. 12.

When the interrupt processing is started, as shown in FIG. 13, the degree-of-superheat controller 41 firstly references the solenoid-operated valve driving signal SV outputted from the temperature controller 10, and judges whether or not the solenoid-operated valve 4 is opened. As a result of the judgment, in case that the valve 4 is opened (Step S81: Yes), the degree-of-superheat controller 41 takes in refrigerant temperatures Tin, Tout at the inlet and outlet of the evaporator 6 respectively (Steps S82, S83) to calculate the present degree-of-superheat Tsh (=Tout−Tin) (Step S84).

Next, a deviation e(t) (=Ts−Tsh) between a set degree-of-superheat (target value of the degree of superheat Tsh) Ts and the present degree-of-superheat Tsh is calculated (Step S85), and based on a set of the deviation e in the past, the proportional band PB, the integration time Ti and the derivative time Td, the operation amount m(t) of the valve opening is calculated with a PID (proportional, integral and differential) calculation in accordance with the above formula 1 (Step S86).

This calculates a target valve opening that the motor-driven valve 5 should reach to, and the degree-of-superheat controller 41 specifies the number of driving pulses such that a valve opening of the valve 5 becomes the target valve opening, and outputs the motor-driven valve driving signal EV to the valve 5 to increase/decrease the valve opening of the valve 5 (Step S87).

On the other hand, as a result of the above judgment in Step S81, in case that the solenoid-operated valve 4 is closed (Step S81: No), any procession is not performed, and changing the valve opening of the motor-driven valve 5 and the like are not carried out.

Figure 14:
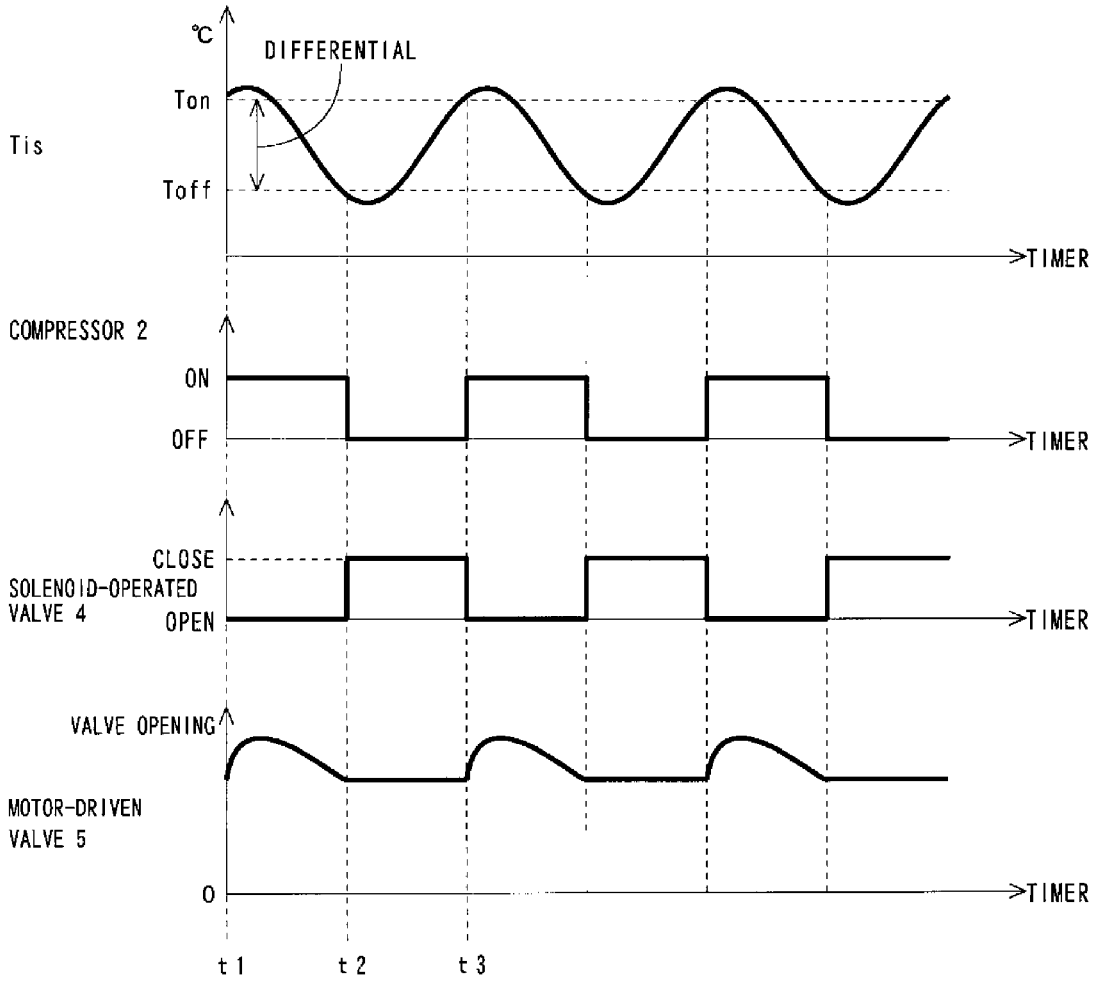
FIG. 14 is a timing diagram showing an example of operations of a solenoid-operated valve and a motor-driven valve when operation/stoppage of a compressor is switched.

Next, operations of the solenoid-operated valve 4 and the motor-driven valve 5, when operation/stoppage of the compressor 2 is switched, will be exemplarily explained mainly with reference to FIG. 14.

In the timing t1, when the inside temperature Tis becomes higher or equal to the ON set temperature Ton, the compressor 2 is operated and the solenoid-operated valve 4 is opened to open the refrigerant flow passage 12*a*. Further, in response to the opening the solenoid-operated valve 4, the valve opening adjustment of the motor-driven valve 5 based on a PID calculation is started to adjust flow rate of a refrigerant circulating in the refrigeration cycle. The operation of the compressor 2, the opening of the solenoid-operated valve 4 and the valve opening adjustment of the motor-driven valve 5 are continuously performed until the inside temperature Tis is higher than the OFF set temperature Toff even if the inside temperature Tis becomes lower or equal to the ON set temperature Ton.

Then, the temperature inside the refrigeration and cold storage show case decreases, and in the timing t2, when the inside temperature Tis reaches to the OFF set temperature Toff, the operation of the compressor 2 is stopped and the solenoid-operated valve 4 is closed to close the refrigerant flow passage 12*a*. In addition, in response to the closing the solenoid-operated valve 4, outputting the motor-driven valve driving signal EV to the motor-driven valve 5 is stopped (the number of driving pulses is set to be zero), and the valve opening adjustment of the valve 5 is suspended. As a result, the valve opening of the motor-driven valve 5 remains as that at the stoppage of the valve opening adjustment, hereinafter, until the valve opening adjustment is restarted, the condition is maintained.

After that, the temperature inside the refrigeration and cold storage show case increases, and in the timing t3, when the inside temperature Tis reaches to the ON set temperature Ton again, the operation of the compressor 2 is restarted and the solenoid-operated valve 4 is opened. At this moment, the valve opening adjustment of the motor-driven valve 5 is restarted, however, the valve opening of the valve 5 at the restarting remains as that at the stoppage of the valve opening adjustment (in the timing t2), so that increase/decrease of the valve opening of the valve 5 after restarting the operation of the compressor 2 starts from the valve opening at the stoppage of the valve opening adjustment.

Therefore, the operation amount of the motor-driven valve 5 in the above case is calculated by deducting the valve opening at the stoppage of the valve opening adjustment from the target valve opening calculated by the PID operation, so that, for instance, the operation amount of the motor-driven valve 5 can considerably be decreased in comparison to a case when shifted to a target valve opening from the fully-closed state. As a result, it is possible to keep the number of driving pulses of the motor-driven valve driving signal EV small, which allows the consumption of the number of driving pulses accompanying the switching of operation/stoppage of the compressor 2 to sharply be reduced.

As mentioned above, in the embodiment, the solenoid-operated valve 4 is mounted between the condenser 3 and the evaporator 6, in addition to that, when the operation of the compressor 2 is stopped, the solenoid-operated valve 4 is closed and the valve opening of the motor-driven valve 5 is maintained as that at the stoppage of the operation of the compressor 2 as well, and when the operation of the compressor 2 is restarted, the solenoid-operated valve 4 is opened and the valve opening control of the motor-driven valve 5 is started from the valve opening at the stoppage of the operation of the compressor 2 as well, which makes the fully-closing operation of the motor-driven valve 5 when stopping the compressor 2 and the opening operation of the motor-driven valve 5 when starting the compressor 2 unnecessary, while preventing the inside temperature from rising when the operation of the compressor 2 is stopped.

As a result, it becomes unnecessary to largely change the valve opening of the motor-driven valve 5 each time that the operation/stoppage of the compressor 2 is switched, which remarkably reduces the consumption of the number of driving pulses. This allows the life of the motor-driven valve 5 to be lengthened, consequently, the reliability of the refrigeration and cold storage system to be improved.

The embodiments of the present invention are explained above, however, this invention is not limited to the above constructions, and various changes can be made in the scope of the invention described in claims.

For example, in the first to the third embodiments, although systems controlling the temperature inside of a refrigeration and cold storage showcase are shown as the refrigeration cycle systems 1, 30 and 40, this invention can widely be applied to other temperature adjustment systems such as air conditioners.

Moreover, in the first to the third embodiments, valve opening of an expansion valve is controlled in a refrigeration cycle, as an example, however, this invention can also be applied to control of a flow control valve (motor-driven valve) in a hot gas by-pass circuit of a refrigeration cycle.

Furthermore, in the first and second embodiments, although wired communication is exemplified as a type of communication between the microprocessors 13 of the degree-of-superheat controllers 11, 31 and the PCs 23, it may be possible to utilize radio communication for connecting the microprocessors 13 and the PCs 23. This is also applicable to the microprocessor (not shown) of the degree-of-superheat controller 41 according to the third embodiment.

In the first to the third embodiments, the solenoid-operated valve 4 is disposed upstream of the motor-driven valve 5 (between the condenser 3 and the motor-driven valves 5), so long as between the condenser 3 and the evaporator 6, the position where the solenoid-operated valve 4 is disposed is not limited in particular, and the valve 4 may be disposed downstream of the motor-driven valve 5 (between the motor-driven valve 5 and the evaporator 6).

Further, in the first to the third embodiments, though the temperature controller 10 and the degree-of-superheat controllers 11, 31, 41 are separately constructed for convenience of explanation, these controllers can be integrated as a single microcomputer and others. In such a case, information on opened/closed state of the solenoid-operated valve 4 from the temperature controller 10 toward the degree-of-superheat controllers 11, 31, and 41 (the solenoid-operated valve driving signal SV) can be managed through inner procession of the microcomputer.

Although outputting the solenoid-operated valve driving signal SV to the degree-of-superheat controller 41 allows opened/closed state of the solenoid-operated valve 4 to be informed to the degree-of-superheat controller 41 in the first to the third embodiments, the solenoid-operated valve driving signal SV is not always used, but other signal capable of informing the opened/closed state of the solenoid-operated valve 4 can be outputted to the degree-of-superheat controller 41.

Still further, in the first to the third embodiments, valve opening of the motor-driven valve 5 is exemplarily controlled by PID control, in addition to that, P (proportional) control, PI (proportional and integral) control, or PD (proportional and differential) control can be used.

EXPLANATION OF REFERENCE NUMBERS

1 refrigeration cycle system
2 compressor
3 condenser
3*a* condenser fan
4 solenoid-operated valve
5 motor-driven valve
5*a* pulse motor
6 evaporator
6*a* evaporator fan
7 inlet temperature sensor
8 outlet temperature sensor
9 inside temperature sensor
10 temperature controller
11 degree-of-superheat controller
12 conduit
12*a* refrigerant flow passage
13 micro processor
13*a* A/D converter
13*b* CPU
13*c* ROM
13*d* RAM
13*e* timer
13*f* I/O
14 inlet temperature detecting circuit
15 outlet temperature detecting circuit
16 motor-driven valve driving circuit
16*a* driver IC
17 input circuit
17*a* up switch
17*b* down switch
17*c* set switch
17*d* enter switch

18 display circuit
18*a* temperature displaying element
18*b* valve opening displaying element
18*c* LEDs
19 display driver circuit
20 memory circuit
21 control signal input circuit
22 communication signal conversion circuit
23 PC
23*a* connection cable
30 refrigeration cycle system
31 degree-of-superheat controller
34 inlet temperature detecting circuit
34*a* bridge circuit
34*b* amplifying circuit
35 outlet temperature detecting circuit
35*a* bridge circuit
35*b* amplifying circuit
40 refrigeration and cold storage system
41 degree-of-superheat controller

The invention claimed is:

1. A controller for controlling operation of a refrigeration and cold storage system, said refrigeration and cold storage system having a refrigeration cycle in which a compressor, a condenser, a motor-driven expansion valve and an evaporator are connected in this order and a solenoid-operated valve disposed between the condenser and the evaporator to open/close a refrigerant flow passage between them, said refrigeration and cold storage system switching operation/stoppage of the compressor in accordance with a temperature of a controlled object, the controller further comprising:

a first control section for switching operation/stoppage of the compressor in accordance with the temperature of the controlled object and controlling opening/closing of the solenoid-operated valve while outputting a signal for opening/closing the solenoid-operated valve;

at least two sensors for sensing a degree of superheat of refrigerant flowing through the evaporator based on a comparison of a temperature of refrigerant at an inlet of the evaporator, $T_{in}$, and a temperature of refrigerant at an outlet of the evaporator, $T_{out}$; and a second control section for controlling valve opening of the motor-driven expansion valve in accordance with the degree of superheat of a refrigerant flowing the evaporator;

wherein said second control section monitors opened/closed state of the solenoid-operated valve based on the signal for opening/closing the solenoid-operated valve that is outputted from the first control section and stops outputting a driving signal for the valve opening control in accordance with the closing of the solenoid-operated valve;

wherein said controller, when stopping the operation of the compressor, closes the solenoid-operated valve and maintains a valve opening of the motor-driven expansion valve at an opening when the operation of the compressor stops in response to a signal being generated for opening/closing the solenoid-operated valve, and when restarting the operation of the compressor, opens the solenoid-operated valve and starts valve opening control of the motor-driven expansion valve from the opening at the stoppage of the compressor in response to a signal being generated for opening/closing the solenoid-operated valve;

wherein said controller is further configured to operate in an emergency mode when one of the following conditions is met: $T_{in}$ is above a predetermined abnormal high temperature, $T_{in}$ is below a predetermined abnormal low temperature, $T_{out}$ is above a predetermined abnormal high temperature, and $T_{out}$ is below a predetermined abnormal low temperature, in the emergency mode, the second control section transitions the motor-driven expansion valve to a predetermined emergency valve opening position.

2. The controller of the refrigeration and cold storage system as claimed in claim 1, wherein the first control section operates the compressor when the temperature of the controlled object is higher or equal to a first setting value that is set at a predetermined temperature, and the first control section stops operation of the compressor when the temperature of the controlled object is lower or equal to a second setting value that is lower than the first setting value.

3. The controller of the refrigeration and cold storage system as claimed in claim 1, wherein the refrigeration and cold storage system is used for a refrigeration and cold storage showcase for foods, and the temperature of controlled object is inside temperature of the refrigeration and cold storage showcase.

4. The controller of the refrigeration and cold storage system as claimed in claim 1, wherein the controller is configured to operate in the emergency mode based on a single temperature reading.

5. A method of controlling operation of a refrigeration and cold storage system, said refrigeration and cold storage system having a refrigeration cycle in which a compressor, a condenser, a motor-driven expansion valve and an evaporator are connected in this order and a solenoid-operated valve disposed between the condenser and the evaporator to open/close a refrigerant flow passage between them, said refrigeration and cold storage system switching operation/stoppage of the compressor in accordance with a temperature of a controlled object, wherein said method comprising the steps of;

switching operation/stoppage of the compressor in accordance with the temperature of the controlled object and controlling opening/closing of the solenoid-operated valve while outputting a signal for opening/closing the solenoid-operated valve;

sensing a degree of superheat of refrigerant flowing through the evaporator based on a comparison of a temperature of refrigerant at an inlet of the evaporator, $T_{in}$, and a temperature of refrigerant at an outlet of the evaporator, $T_{out}$; and controlling valve opening of the motor-driven expansion valve in accordance with the degree of superheat of a refrigerant flowing the evaporator;

monitoring the opened/closed state of the solenoid-operated valve based on the signal for opening/closing the solenoid-operated valve and stopping the output of a driving signal for the valve opening control in accordance with the closing of the solenoid-operated valve:

when stopping the operation of the compressor, closing the solenoid-operated valve and maintaining a valve opening of the motor-driven expansion valve at an opening when the operation of the compressor stops in response to a signal being generated for opening/closing the solenoid-operated valve; and when restarting the operation of the compressor, opening the solenoid-operated valve and starting valve opening control of the motor-driven expansion valve from the opening at the stoppage of the compressor in response to a signal being generated for opening/closing the solenoid-operated valve operating in an emergency mode when one of the following conditions is met: $T_{in}$ is above a predetermined abnormal high temperature, $T_{in}$ is below a prescribed abnormal low temperature, $T_{out}$ is above a predetermined abnormal high temperature, and $T_{out}$ is below a predetermined abnormal low temperature, in the emergency mode, transitioning the motor-driven expansion valve to a predetermined emergency valve opening position.

6. The method recited in claim 5, wherein the operating in the emergency mode step is implemented in response to detecting a single temperature.

* * * * *